US012484748B2

(12) United States Patent
Der Marderosian et al.

(10) Patent No.: US 12,484,748 B2
(45) Date of Patent: Dec. 2, 2025

(54) NOZZLE FOR A SURFACE TREATMENT APPARATUS AND A SURFACE TREATMENT APPARATUS HAVING THE SAME

(71) Applicant: SHARKNINJA OPERATING LLC, Needham, MA (US)

(72) Inventors: Daniel R. Der Marderosian, Westwood, MA (US); Nathan Herrmann, Middlebury, VT (US); Max P. Lacoma, Huntington, NY (US); Devan Schappler, Bedford, NH (US); Adam Udy, Sutton (GB); Donald Williams, Boston, MA (US); Steven Gacin, Pawtucket, RI (US); Patrick Cleary, Allston, MA (US); Xavier Cullere, Newton, MA (US)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 18/238,141

(22) Filed: Aug. 25, 2023

(65) Prior Publication Data

US 2023/0397784 A1 Dec. 14, 2023

Related U.S. Application Data

(63) Continuation of application No. 17/388,883, filed on Jul. 29, 2021, now Pat. No. 11,832,778.

(Continued)

(51) Int. Cl.

*A47L 9/04* (2006.01)
*A47L 9/06* (2006.01)

(52) U.S. Cl.

CPC ..... *A47L 9/0477* (2013.01); *A47L 9/0411* (2013.01); *A47L 9/0488* (2013.01); *A47L 9/0613* (2013.01)

(58) Field of Classification Search

CPC .... A47L 9/0477; A47L 9/0613; A47L 9/0411; A47L 9/0488; A47L 9/0483; A47L 9/02;

(Continued)

(56) References Cited

U.S. PATENT DOCUMENTS 1,770,643 A 7/1930 Giambertoni
2,411,488 A 11/1946 White (Continued)

FOREIGN PATENT DOCUMENTS

CN 203898204 10/2014
CN 105392407 3/2016

(Continued)

OTHER PUBLICATIONS

PCT Search Report and Written Opinion mailed Mar. 18, 2021, received in PCT Application No. PCT/US20/65591, 10 pages.

(Continued)

*Primary Examiner* — Marc Carlson

(74) *Attorney, Agent, or Firm* — Grossman Tucker Perreault & Pfleger, PLLC

(57) ABSTRACT

An agitator including an elongated main body configured to rotate about a pivot axis, one or more soft cleaning features coupled to and extending over a substantial portion of a surface of the elongated main body, the one or more soft cleaning features defining at least one channel, and at least one deformable flap disposed at least partially within the at least one channel and extending from the elongated main body. The deformable flap may extend beyond an outer surface of the soft cleaning features. The channel may have a generally U shape and/or V shape. The channel may be configured to allow the resiliently deformable flap to move front to back as the agitator rotates about the pivot axis.

22 Claims, 32 Drawing Sheets

Related U.S. Application Data

(60) Provisional application No. 63/058,371, filed on Jul. 29, 2020.

(58) Field of Classification Search
CPC ... A47L 9/127; A47L 9/04; A47L 9/06; A47L 9/12; A47L 9/00; A46B 9/026
USPC ..... 15/383
See application file for complete search history.

(56) References Cited

U.S. PATENT DOCUMENTS 2,682,679 A 7/1954 Ballard
3,874,017 A * 4/1975 Parker ..... A46B 13/005 15/182
4,008,505 A 2/1977 Clowers
4,457,045 A 7/1984 Kegg
4,777,691 A * 10/1988 Richmond ..... A47L 9/0477 15/183
5,029,361 A * 7/1991 Murata ..... A47L 9/0416 15/366
5,123,141 A 6/1992 Erickson et al.
5,611,109 A * 3/1997 Worwag ..... A47L 9/0477 15/97.1
6,134,745 A 10/2000 Worwag
6,256,832 B1 7/2001 Dyson
6,323,570 B1 11/2001 Nishimura et al.
6,345,411 B1 2/2002 Kato et al.
6,351,872 B1 3/2002 McCormick
6,463,623 B2 10/2002 Ahn et al.
6,539,575 B1 * 4/2003 Cohen ..... A46B 13/001 15/364
6,757,934 B2 7/2004 Park
6,772,476 B2 8/2004 Park
6,785,933 B2 9/2004 Kim et al.
6,848,147 B2 2/2005 Syverson et al.
7,022,003 B1 4/2006 Hughes
7,079,923 B2 7/2006 Abramson et al.
7,237,298 B2 7/2007 Reindle et al.
8,256,059 B2 * 9/2012 Morphey ..... A46B 13/02 15/179
8,533,905 B1 9/2013 Tran
8,776,310 B2 7/2014 Genn et al.
8,776,311 B2 7/2014 Genn et al.
8,898,858 B2 12/2014 Dyson et al.
9,015,897 B2 4/2015 Jonsson et al.
9,095,244 B2 8/2015 Jonsson et al.
9,326,654 B2 5/2016 Doughty
9,681,785 B2 6/2017 Kleine-Doepke et al.
9,848,746 B2 12/2017 Feng
10,426,306 B2 * 10/2019 Isley ..... A47L 9/0477
10,631,702 B2 * 4/2020 Xia ..... A47L 11/4041
10,646,083 B2 5/2020 Kim et al.
10,722,087 B2 * 7/2020 Conrad ..... A47L 9/0477
10,932,631 B2 * 3/2021 Conrad ..... A47L 11/24
11,503,968 B2 * 11/2022 Freese ..... A47L 9/30
2006/0021184 A1 2/2006 Hawkins et al.
2008/0086837 A1 4/2008 Son et al.
2008/0120803 A1 5/2008 Bryant
2009/0229075 A1 9/2009 Eriksson
2010/0299863 A1 12/2010 Dewing
2013/0058635 A1 3/2013 Vrdoljak
2013/0152337 A1 6/2013 Thorne
2014/0053351 A1 * 2/2014 Kapoor ..... A47L 11/4013 15/52.1
2014/0150201 A1 6/2014 Mcgee et al.
2014/0259522 A1 * 9/2014 Kasper ..... A47L 9/1683 15/383
2014/0352104 A1 12/2014 Eriksson
2015/0013102 A1 1/2015 Bilger
2015/0040340 A1 2/2015 Bilger et al.
2015/0059122 A1 3/2015 Kim et al.
2015/0135474 A1 5/2015 Gidwell
2015/0223655 A1 8/2015 Cole et al.
2015/0265117 A1 9/2015 Genn et al.
2015/0297054 A1 10/2015 Weeks et al.
2015/0351596 A1 12/2015 Thorne
2016/0128530 A1 5/2016 Thorne et al.
2016/0166052 A1 * 6/2016 Kasper ..... A46B 13/001 15/179
2016/0174792 A1 * 6/2016 Williamson ..... A46B 13/00 15/383
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0345792 A1 * 12/2016 Herron ..... A47L 9/0477
2016/0374533 A1 12/2016 Innes et al.
2017/0007086 A1 1/2017 Kleine-Doepke et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0280957 A1 10/2017 Jeong et al.
2017/0325646 A1 11/2017 Kim et al.
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0125315 A1 * 5/2018 Kasper, Jr. ..... A46B 13/001
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0150686 A1 5/2019 Horne et al.
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0298052 A1 * 10/2019 Conrad ..... A46B 13/006
2019/0298123 A1 10/2019 Conrad et al.
2019/0298125 A1 10/2019 Conrad et al.
2019/0302793 A1 10/2019 Leech et al.
2019/0307302 A1 * 10/2019 Zheng ..... A47L 9/0477
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037843 A1 2/2020 Fiebig et al.
2020/0046183 A1 * 2/2020 Choi ..... A47L 9/0477
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 * 4/2020 Gacin ..... A47L 9/0613
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.

(56) References Cited

U.S. PATENT DOCUMENTS

| | | | | |
|---|---|---|---|---|
| 2020/0301430 | A1 | 9/2020 | Irkliy et al. | |
| 2020/0315416 | A1* | 10/2020 | Hong | A47L 9/0488 |
| 2020/0315418 | A1 | 10/2020 | Howard et al. | |
| 2020/0345196 | A1 | 11/2020 | Innes et al. | |
| 2020/0367711 | A1 | 11/2020 | Thorne et al. | |
| 2020/0371526 | A1 | 11/2020 | Kamada | |
| 2020/0383547 | A1 | 12/2020 | Sutter et al. | |
| 2021/0007569 | A1 | 1/2021 | Howard et al. | |
| 2021/0022574 | A1 | 1/2021 | Harting | |
| 2021/0030227 | A1 | 2/2021 | Mathieu et al. | |
| 2021/0038032 | A1 | 2/2021 | Brown | |
| 2021/0059495 | A1 | 3/2021 | Gill et al. | |
| 2021/0068600 | A1* | 3/2021 | Xing | A46B 9/005 |
| 2021/0068602 | A1 | 3/2021 | Carter | |
| 2021/0085144 | A1 | 3/2021 | Woodrow et al. | |
| 2021/0094077 | A1 | 4/2021 | Kane et al. | |
| 2021/0169289 | A1 | 6/2021 | Thorne et al. | |
| 2021/0175772 | A1 | 6/2021 | Aini | |
| 2021/0177223 | A1 | 6/2021 | Der Marderosian et al. | |
| 2021/0186282 | A1 | 6/2021 | Mathieu et al. | |
| 2021/0204684 | A1 | 7/2021 | Heman-Ackah et al. | |
| 2021/0254615 | A1 | 8/2021 | Vrdoljak et al. | |
| 2021/0307581 | A1 | 10/2021 | Thorne et al. | |
| 2021/0315428 | A1 | 10/2021 | Udy et al. | |
| 2021/0386261 | A1 | 12/2021 | Woodrow et al. | |
| 2021/0386262 | A1 | 12/2021 | Uchendu et al. | |
| 2021/0393024 | A1* | 12/2021 | Forbes | A46B 13/02 |
| 2022/0031131 | A1 | 2/2022 | McClay et al. | |
| 2022/0031133 | A1 | 2/2022 | Der Marderosian et al. | |
| 2022/0031134 | A1 | 2/2022 | Yang et al. | |
| 2022/0053984 | A1* | 2/2022 | Karlsson | A47L 11/4041 |
| 2022/0061614 | A1 | 3/2022 | Yu et al. | |
| 2022/0071459 | A1 | 3/2022 | Gacin et al. | |
| 2022/0095864 | A1 | 3/2022 | Der Marderosian et al. | |
| 2022/0125256 | A1 | 4/2022 | Lessard et al. | |
| 2022/0233038 | A1* | 7/2022 | Goncalves | A47L 9/0411 |
| 2022/0265102 | A1* | 8/2022 | Park | A46B 9/026 |
| 2022/0287521 | A1 | 9/2022 | Cottrell et al. | |
| 2022/0322903 | A1 | 10/2022 | Lessard | |
| 2022/0400922 | A1 | 12/2022 | McClay et al. | |
| 2022/0408994 | A1 | 12/2022 | Hill | |
| 2023/0043567 | A1 | 2/2023 | Copeland et al. | |
| 2023/0070147 | A1 | 3/2023 | Harting et al. | |
| 2023/0157495 | A1 | 5/2023 | Copeland et al. | |
| 2023/0248192 | A1 | 8/2023 | Brown et al. | |
| 2023/0329502 | A1 | 10/2023 | Chirikjian | |
| 2024/0415352 | A1 | 12/2024 | McClay et al. | |

FOREIGN PATENT DOCUMENTS

| | | |
|---|---|---|
| CN | 110477803 | 11/2019 |
| CN | 211270505 | 8/2020 |
| DE | 1967828 | 9/1967 |
| EP | 0313403 | 3/1993 |
| EP | 2280630 | 2/2016 |
| EP | 3003111 | 12/2016 |
| JP | S63154144 | 6/1988 |
| JP | 2011188951 | 9/2011 |
| JP | 2017502773 | 1/2017 |
| KR | 20120139748 | 12/2012 |
| KR | 20160013267 | 2/2016 |
| KR | 20160037235 | 4/2016 |
| WO | 2020081931 | 4/2020 |

OTHER PUBLICATIONS

PCT Search Report and Written Opinion mailed Nov. 17, 2021, received in PCT Application No. PCT/US21/43730, 10 pages.

Japanese Office Action with machine-generated English translation issued Nov. 28, 2023, received in Japanese Patent Application No. 2023-506277, 10 pages.

US Office Action issued Dec. 6, 2023, received in U.S. Appl. No. 17/497,182, 34 pages.

PCT Search Report and Written Opinion mailed Jan. 31, 2022, received in corresponding PCT Application No. PCT/US21/54153, 11 pages.

Chinese Notification of Office Action with English summary issued Feb. 21, 2023, received in Chinese Patent Application No., 202080087870.0, including chart on p. 10 of the Notification, 13 pages.

U.S. Office Action issued Jan. 31, 2023, received in U.S. Appl. No. 17/125,197, 17 pages.

Canadian Office Action issued Jun. 30, 2023, received in Canadian Patent Application No. 3,162,078, 6 pages.

Australian Examination Report issued Aug. 11, 2023, received in Australian Patent Application No. 2020405017, 4 pages.

Japanese Office Action with machine-generated English translation issued Aug. 29, 2023, received in Japanese Patent Application No. 2022-537110, 10 pages.

US Office Action issued Aug. 18, 2023, received in U.S. Appl. No. 17/125,197, 17 pages.

Chinese Office Action with machine-generated English translation issued Aug. 31, 2023, received in Chinese Patent Application No. 202080087870.0, 21 pages.

Japanese Office Action with English translation issued Mar. 5, 2024, received in Japanese Patent Application No. 2023-521574, 7 pages.

Australian Examination Report issued Apr. 30, 2024, received in Australian Patent Application No. 2021358994, 5 pages.

U.S. Office Action issued Apr. 29, 2024, received in U.S. Appl. No. 17/497,182, 25 pages.

Korean Office Action issued with English translation issued May 30, 2024, received in Korean Patent Application No. 10-2022-7024493, 21 pages.

Extended European Search Report dated May 24, 2024, received in European Patent Application No. 20900854.9, 9 pages.

Extended European Search Report dated Jun. 27, 2024 received in European Patent Application No. 21849306.2, 9 pages.

Canadian Office Action issued Aug. 2, 2024, received in Canadian Patent Application No. 3,195, 139, 4 pages.

U.S. Office Action issued Jan. 22, 2025, received in U.S. Appl. No. 17/497,182, 28 pages.

Extended European Search Report dated Feb. 14, 2025, received in European Patent Application No. 21878610.1, 11 pages.

Korean Request for the Submission of an Opinion with machine-generated English translation, issued Sep. 19, 2025, received in Korean Patent Application No. 10-2023-7015091, 18 pages.

Japanese Notice of Reasons for Refusal with machine-generated English translation, issued Oct. 14, 2025, received in Japanese Patent Application No. 2024-182062, 6 pages.

European Office Action issued Oct. 8, 2025, received in European Patent Application No. 21849306.2. 8 pages.

* cited by examiner

NOZZLE FOR A SURFACE TREATMENT APPARATUS AND A SURFACE TREATMENT APPARATUS HAVING THE SAME

This application is a continuation of U.S. patent application Ser. No. 17/388,883 filed on Jul. 29, 2021, which claims the benefit of U.S. Provisional Application Ser. No. 63/058,371 filed on Jul. 29, 2020, both of which are fully incorporated herein by reference.

TECHNICAL FIELD

The present disclosure relates generally to a vacuum cleaner, and more particularly, to a vacuum cleaner nozzle including chamfered castellations and/or cambered wheels to maintain suction power while collecting relatively large debris (e.g., cheerios) and improve user experience through improved handling and reduction of wheel-induced noise.

In addition (or alternatively), the present disclosure also relates generally to a vacuum cleaner, and more particularly, to a vacuum cleaner nozzle including a brush roll having an elongated body substantially covered by a soft material with flaps which may improve user experience through improved debris agitation, debris entrapment, and/or reduced noise on a variety of surfaces to be cleaned (e.g., but not limited to, hard surfaces).

BACKGROUND

The following is not an admission that anything discussed below is part of the prior art or part of the common general knowledge of a person skilled in the art.

A vacuum cleaner may be used to clean a variety of surfaces. Some vacuum cleaners include a nozzle with a castellated configuration such that dirt and debris gets drawn into a dirty air inlet via a plurality of different inlets (or inlet paths). Such castellated nozzles allow for increased air velocity and higher suction relative to other nozzle configurations. Narrow castellations generally restrict/confine more area of a suction inlet, and result in higher air velocity during operation. While existing vacuum cleaners with castellated nozzles are generally effective at collecting debris, some larger debris (for example, cheerios) may not pass through the relatively narrow openings/inlets provided by the nozzle, or worse yet can clog the same. On the other hand, widening the inlets of a castellated nozzle tends to lower air velocity, and by extension, decrease suction power and thus nullify the advantages of having the castellations. Accordingly, vacuums with castellated nozzles tend to remain limited to cleaning applications that do not seek to remove large pieces of debris.

BRIEF DESCRIPTION OF THE DRAWINGS

Embodiments are illustrated by way of example in the accompanying figures, in which like reference numbers indicate similar parts, and in which.

DETAILED DESCRIPTION

Figure 1:
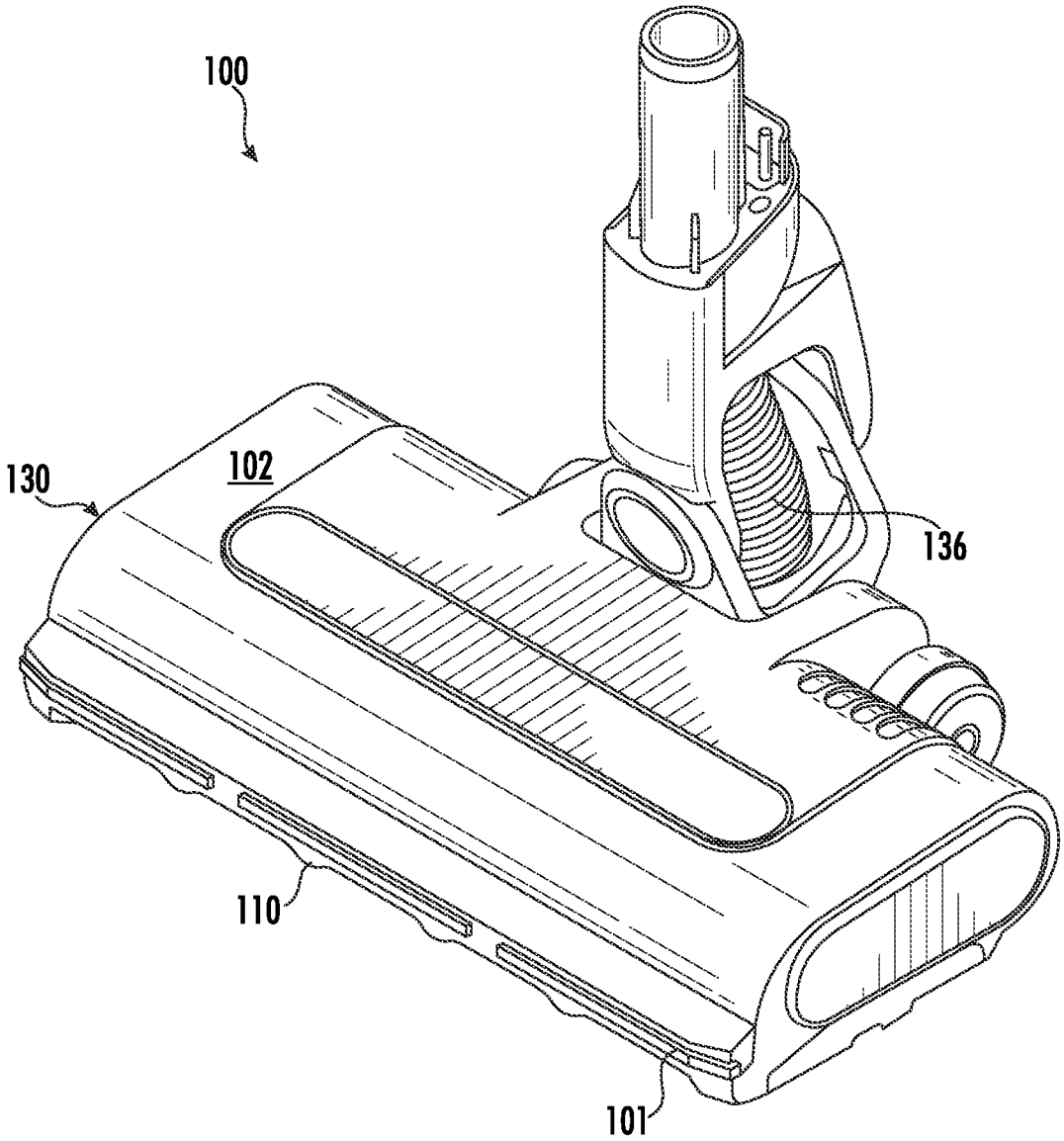
FIG. 1 is an isometric view of one embodiment of a vacuum cleaner nozzle, consistent with embodiments of the present disclosure.

While the making and using of various embodiments of the present disclosure are discussed in detail below, it should be appreciated that the present disclosure provides many applicable inventive concepts that can be embodied in a wide variety of specific contexts. The specific embodiments discussed herein are merely illustrative of specific ways to make and use the disclosure and do not limit the scope of the disclosure.

As discussed above, vacuums with castellated nozzles benefit from high suction power but are unable to be used in a wide-range of cleaning operations, such as those that aim to remove large bits of debris such as cheerios. Worse yet, castellated nozzles tend to get easily clogged as debris such as cheerios can become lodged within the associated channels.

Thus, in accordance with an embodiment of the present disclosure, a nozzle having chamfered castellations is disclosed herein that provides high suction pressure while also allowing for large pieces of debris to pass through the inlet openings. In more detail, a nozzle for a surface treatment apparatus is disclosed herein. The nozzle provides a suction channel through which debris passes into a main body of the surface treatment apparatus. Chamfered castellations are provided along a leading edge of the nozzle to allow debris to pass through the leading edge to the suction channel and into the main body during, for instance, forward and reverse strokes of the surface treatment apparatus.

In an embodiment, the chamfered castellations further include receptacles/cavities to receive and securely hold wheels therein. The wheels may be advantageously located at a distance which is offset from the sides of the nozzle. This results in improved edge cleaning as the nozzle can be configured with inlets that allow for side-to-side cleaning movements along, for instance, walls. As discussed in further detail below, the wheels may be configured as a cambered wheels.

Nozzles configured consistent with the present disclosure provide numerous advantages and features over existing nozzle configurations. For instance, the chamfered castellations disclosed herein allow for vacuum cleaners implementing the same to be used in a wide-range of cleaning operations, and importantly, cleaning operations that aim to draw in large pieces of debris without getting clogged by the same.

Turning now to FIGS. 1-5, one embodiment of a nozzle 100 is generally illustrated. The term vacuum cleaner nozzle as used herein refers to any type of vacuum cleaner nozzle and may be also referred to as a cleaning head, a cleaning nozzle, or simply a nozzle. Such nozzles may be attached to a vacuum cleaner (or any other surface cleaning device) including, but not limited to, hand-operated vacuum cleaners and robot vacuum cleaners. Further non-limiting examples of hand-operated vacuum cleaners include upright vacuum cleaners, canister vacuum cleaners, stick vacuum cleaners, and central vacuum systems. Thus, while various aspects of the present disclosure may be illustrated and/or described in the context of a hand-operated vacuum cleaner or a robot vacuum cleaner, it should be understood the features disclosed herein are applicable to hand-operated vacuum cleaners, robot vacuum cleaners, and other similar surface cleaning devices unless specifically stated otherwise.

Figure 2:
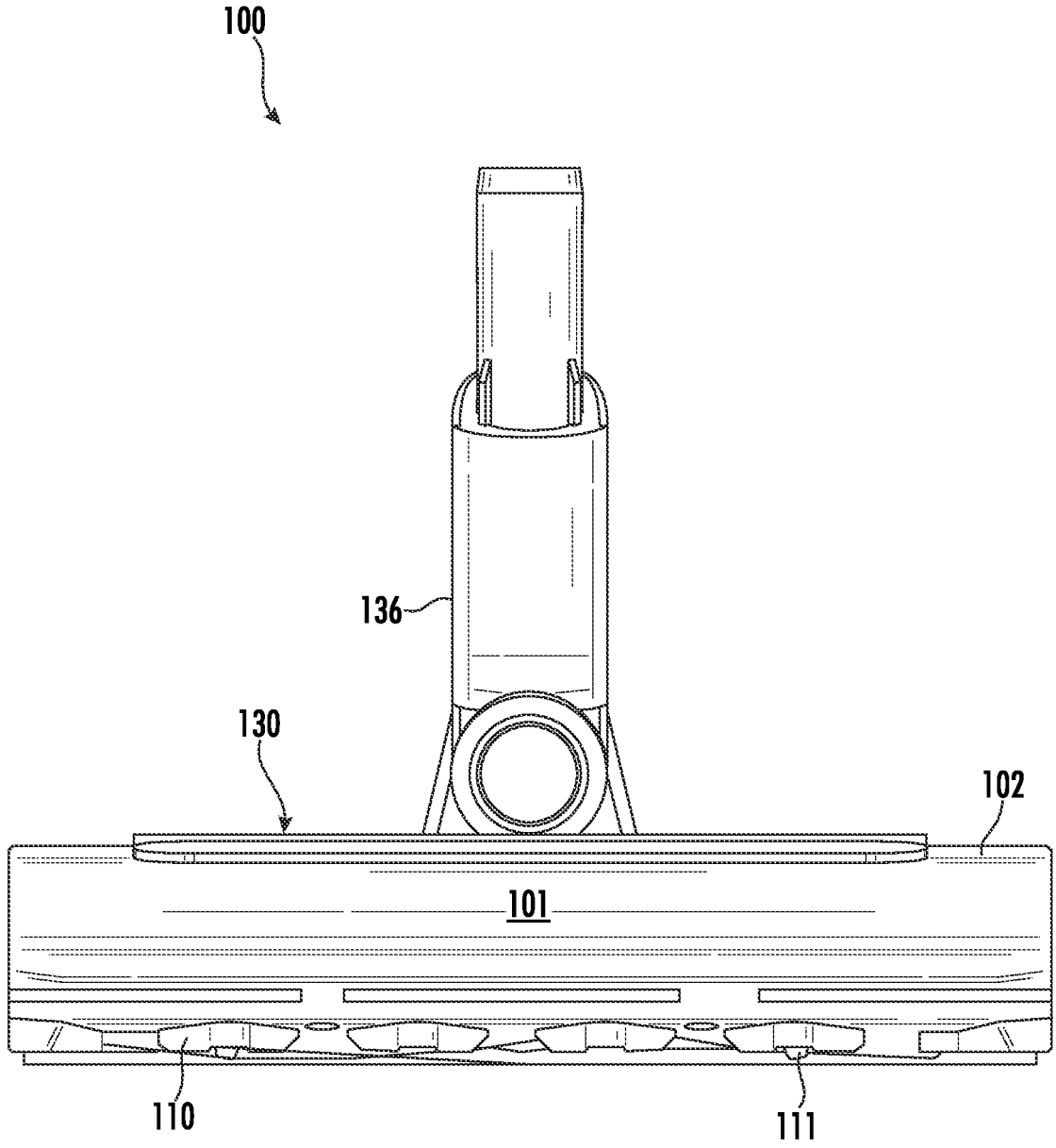
FIG. 2 is a front view of the vacuum cleaner nozzle of FIG. 1, consistent with embodiments of the present disclosure.
Figure 3:
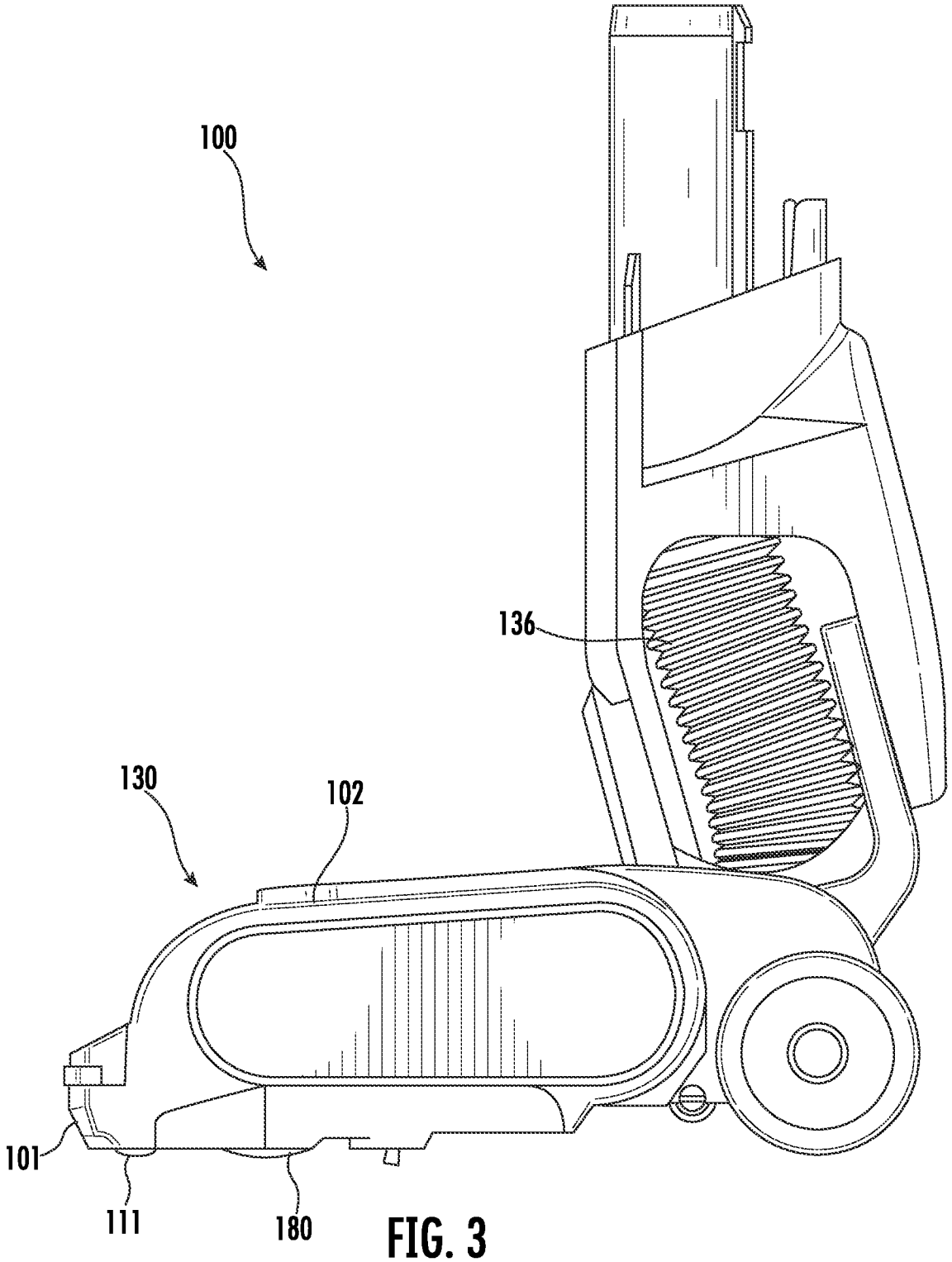
FIG. 3 is a side view of the vacuum cleaner nozzle of FIG. 1, consistent with embodiments of the present disclosure.
Figure 4:
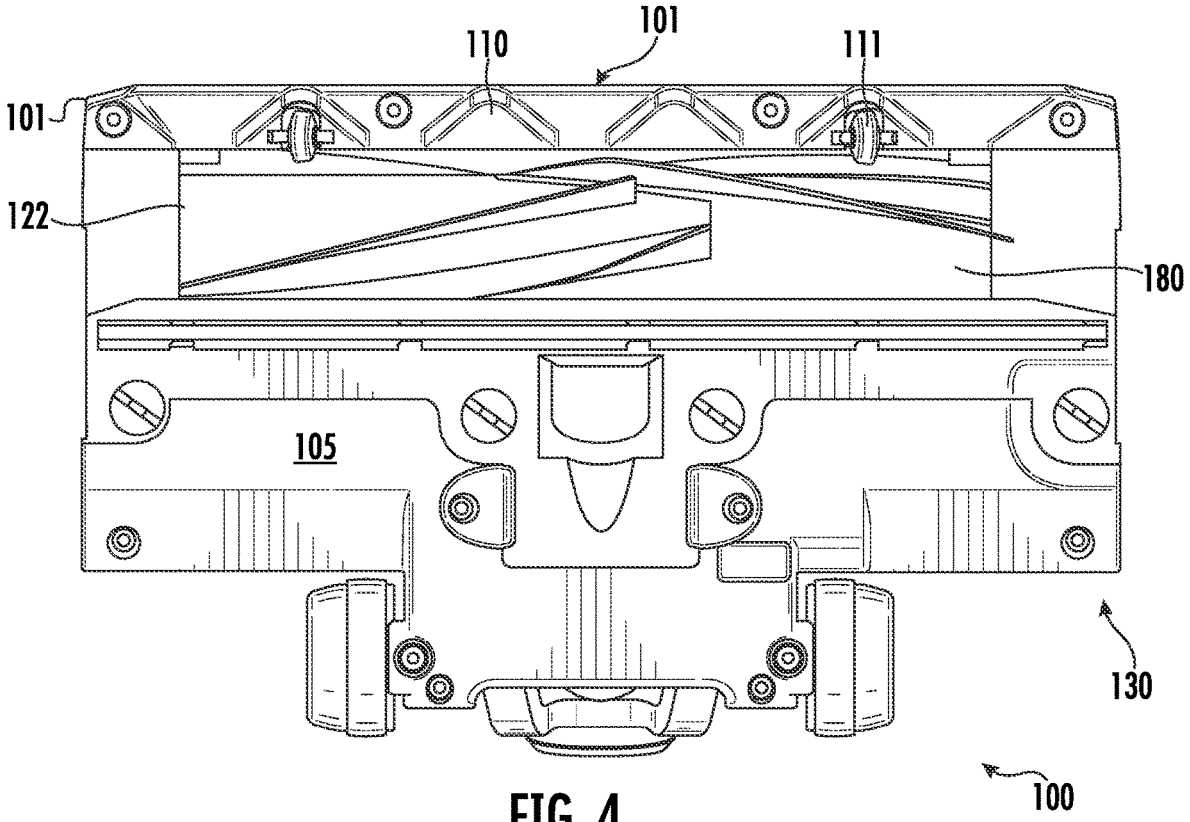
FIG. 4 is a bottom view of the vacuum cleaner nozzle of FIG. 1, consistent with embodiments of the present disclosure.
Figure 5:
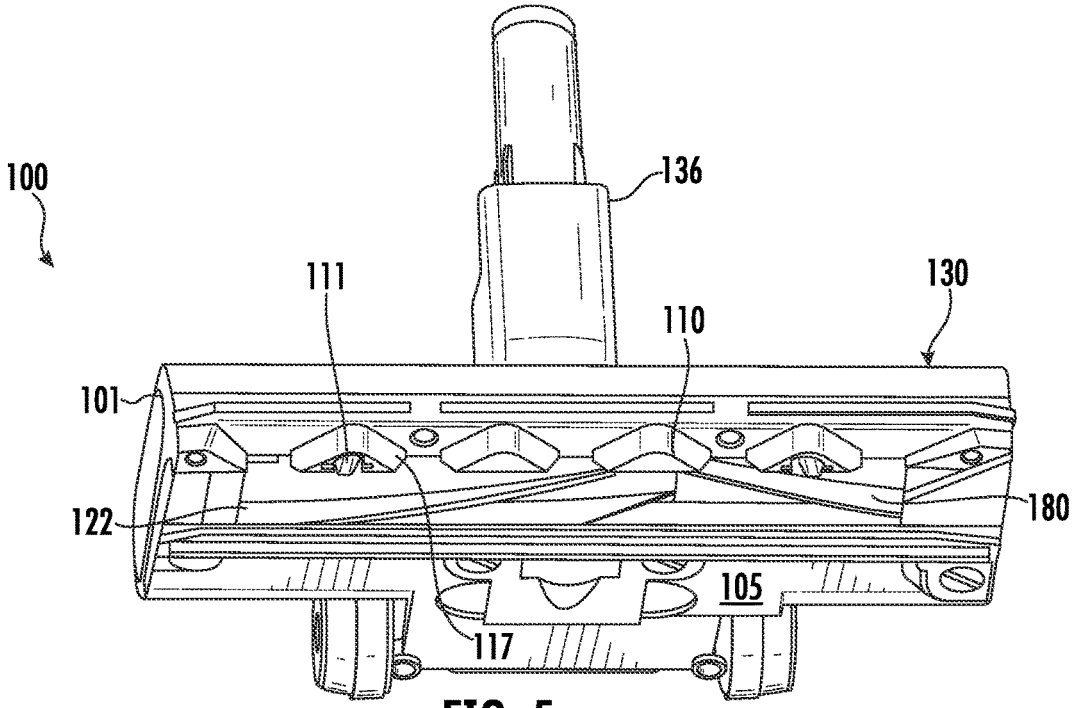
FIG. 5 is a bottom perspective view of the vacuum cleaner nozzle of FIG. 1, consistent with embodiments of the present disclosure.
Figure 6A:
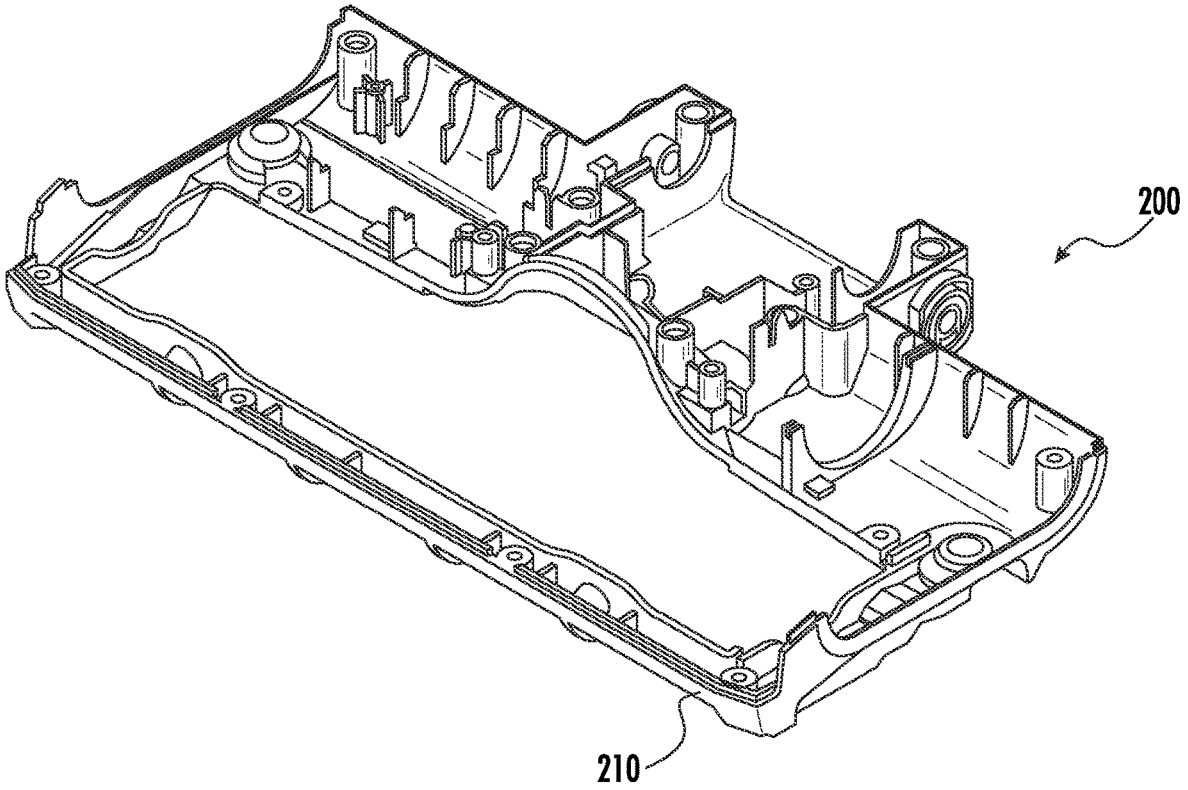
FIG. 6A illustrates an isometric view of one embodiment of a bottom frame of a vacuum cleaner nozzle, consistent with embodiments of the present disclosure.
Figure 6B:
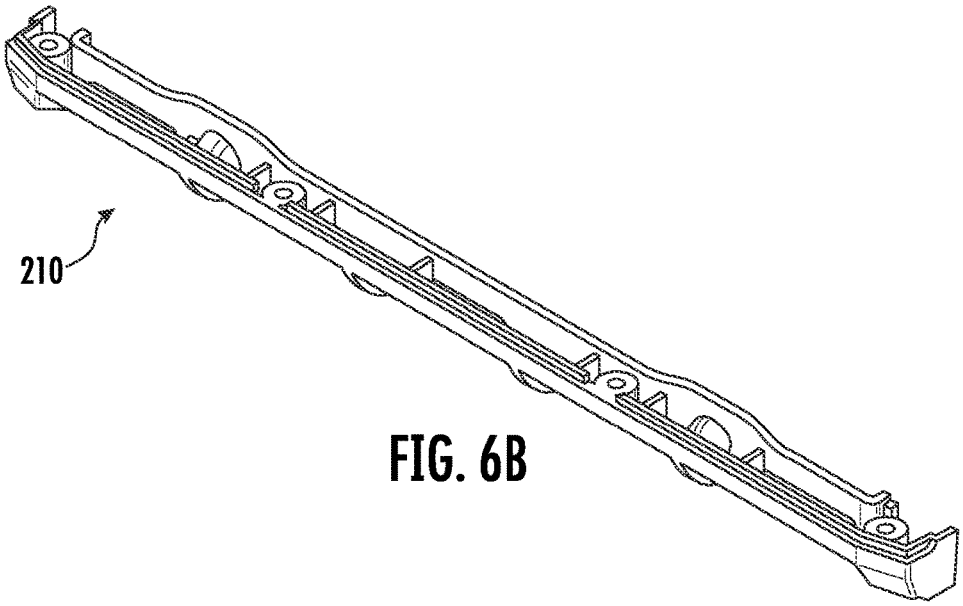
FIG. 6B illustrates an isometric view of the leading edge of the bottom frame of FIG. 6A, consistent with embodiments of the present disclosure.
Figure 7A:
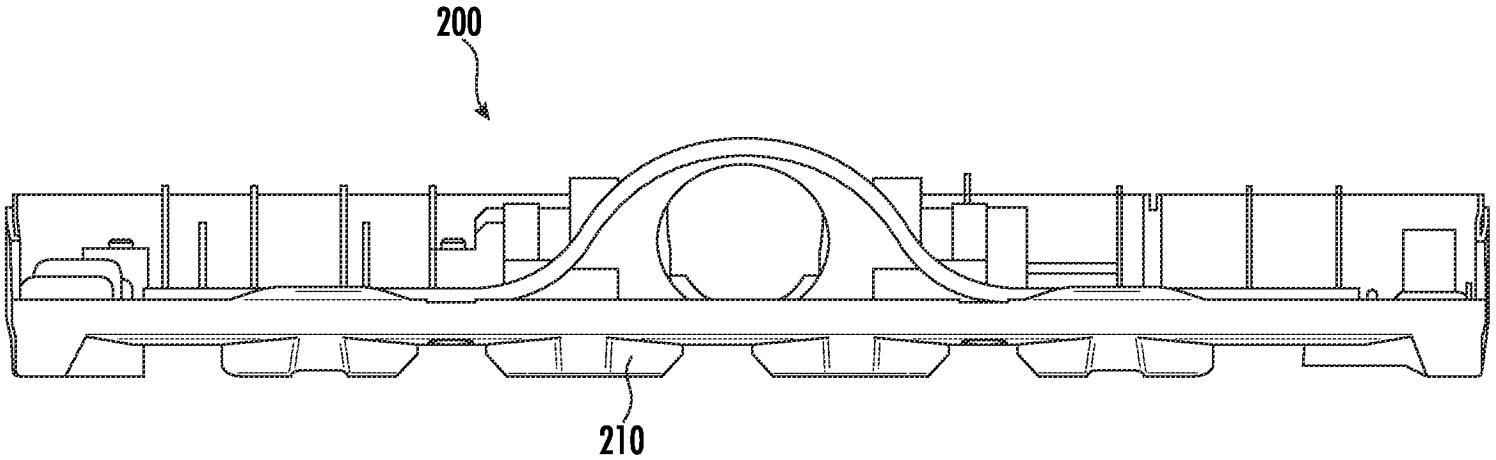
FIG. 7A illustrates a front view of the bottom frame of a vacuum cleaner nozzle of FIG. 6A, consistent with embodiments of the present disclosure.
Figure 7B:
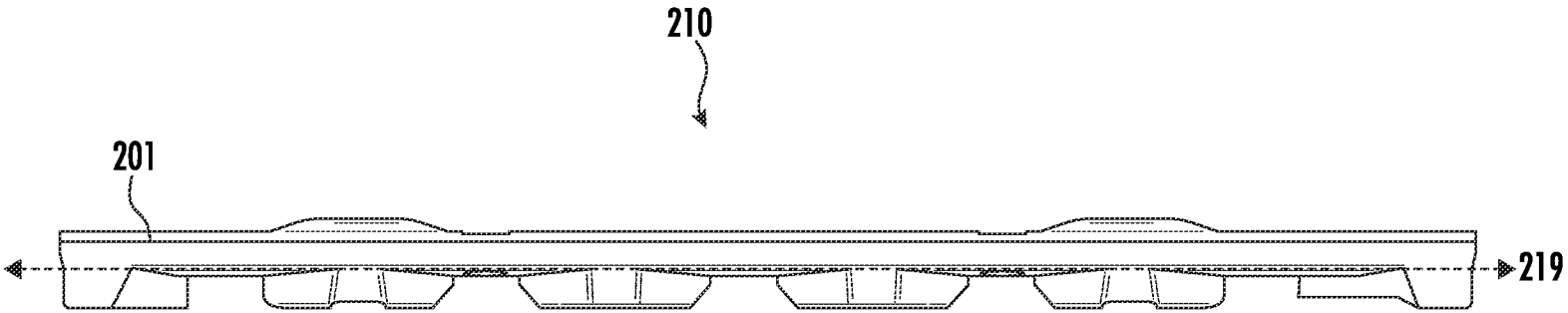
FIG. 7B illustrates a front view of the leading edge of the bottom frame of FIG. 7A, consistent with embodiments of the present disclosure.
Figure 8A:
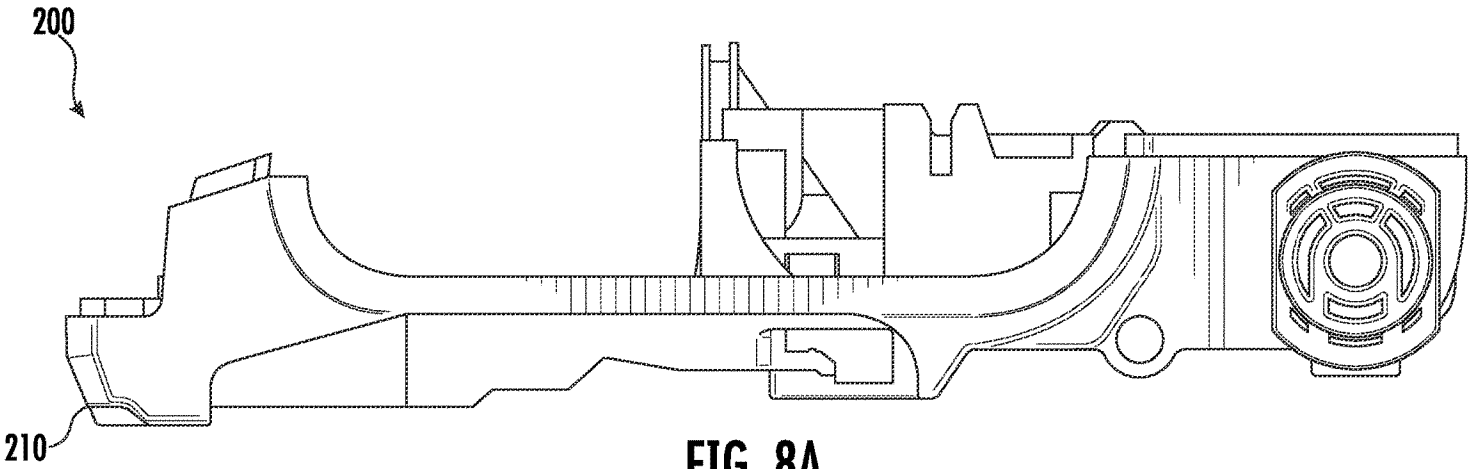
FIG. 8A illustrates a side view of the bottom frame of a vacuum cleaner nozzle of FIG. 6A, consistent with embodiments of the present disclosure.
Figure 8B:
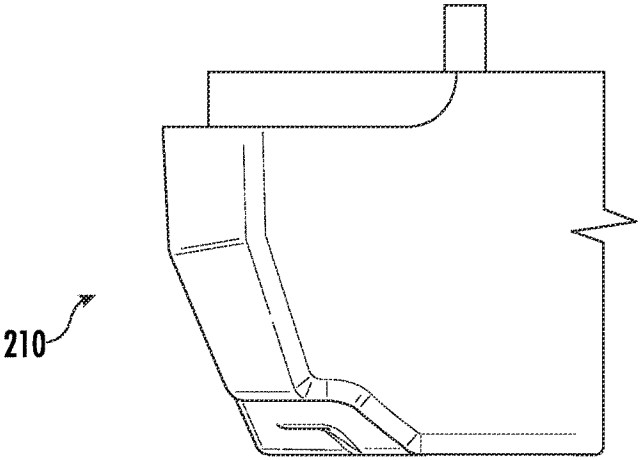
FIG. 8B illustrates a side view of the leading edge of the bottom frame of FIG. 8A, consistent with embodiments of the present disclosure.
Figure 9A:
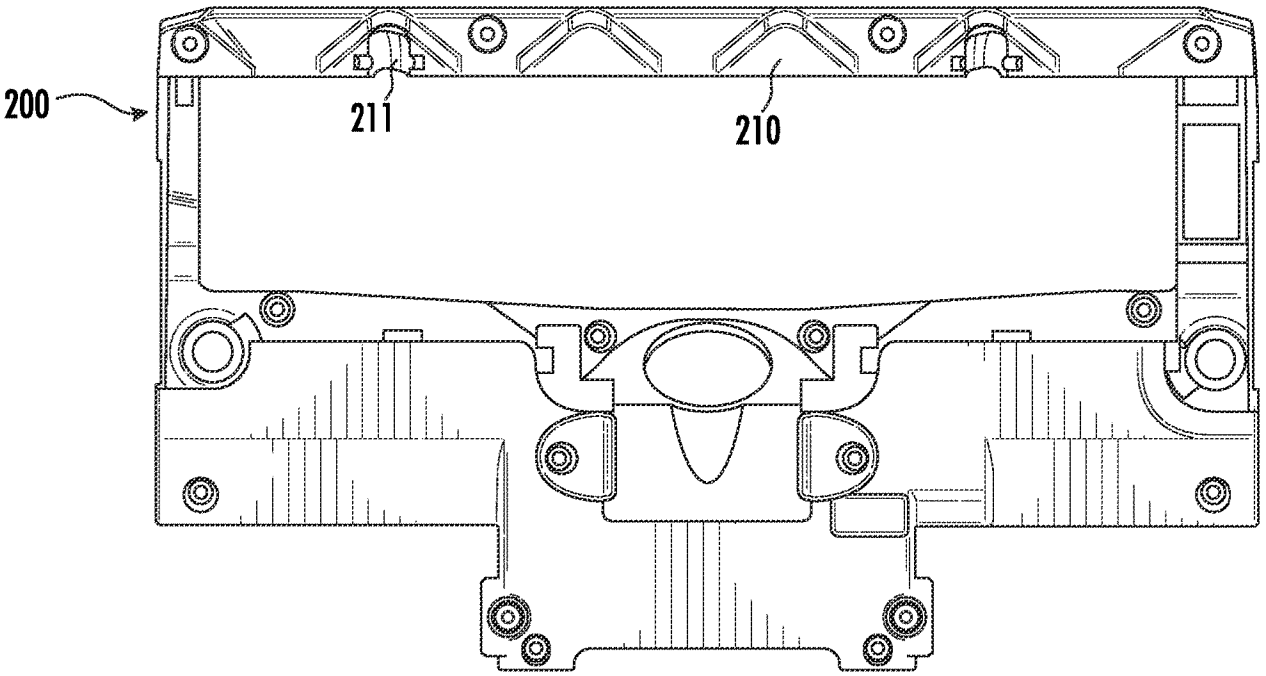
FIG. 9A illustrates a bottom view of the bottom frame of a vacuum cleaner nozzle of FIG. 6A, consistent with embodiments of the present disclosure.
Figure 9B:
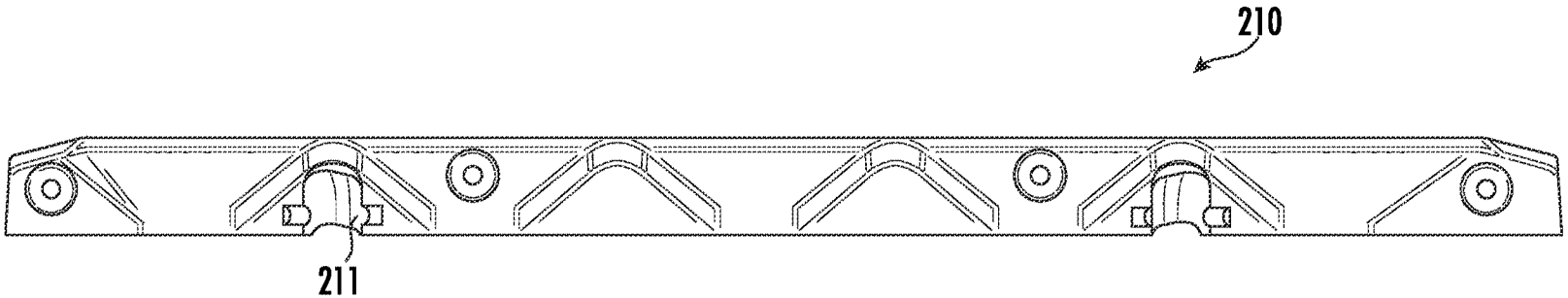
FIG. 9B illustrates a bottom view of the leading edge of the bottom frame of FIG. 9A, consistent with embodiments of the present disclosure.
Figure 10:
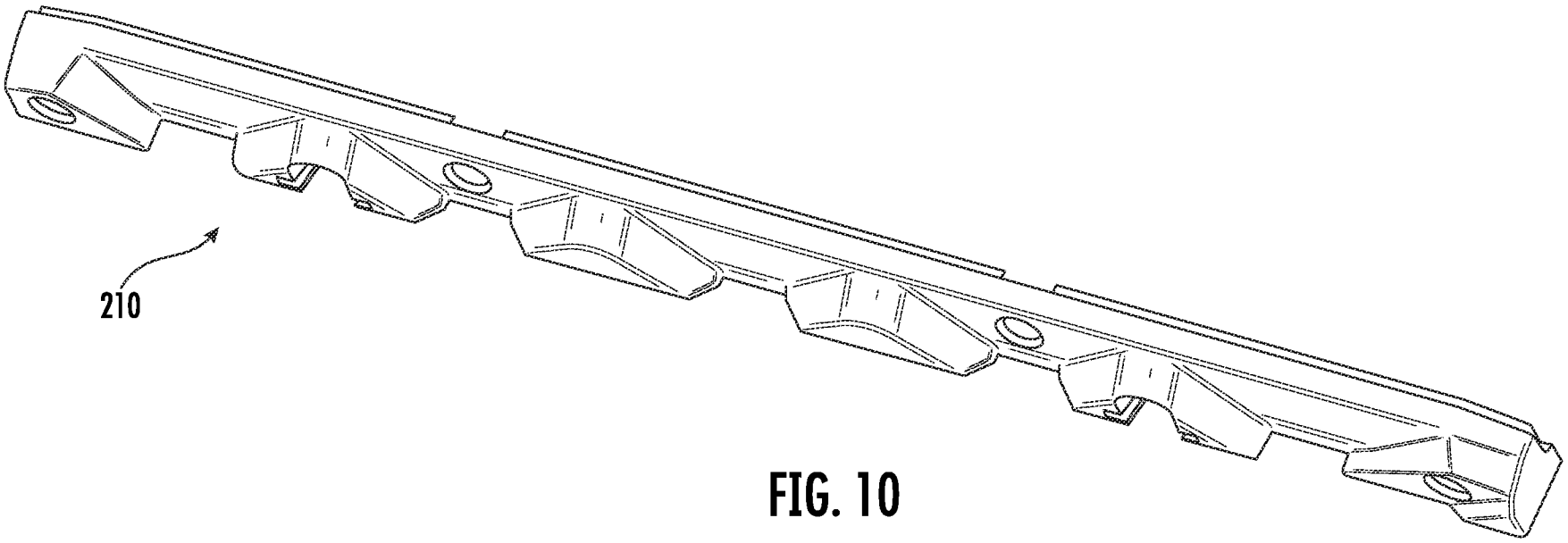
FIG. 10 illustrates an isometric view of the leading edge of the bottom frame of FIG. 9A, consistent with embodiments of the present disclosure.
Figure 11A:
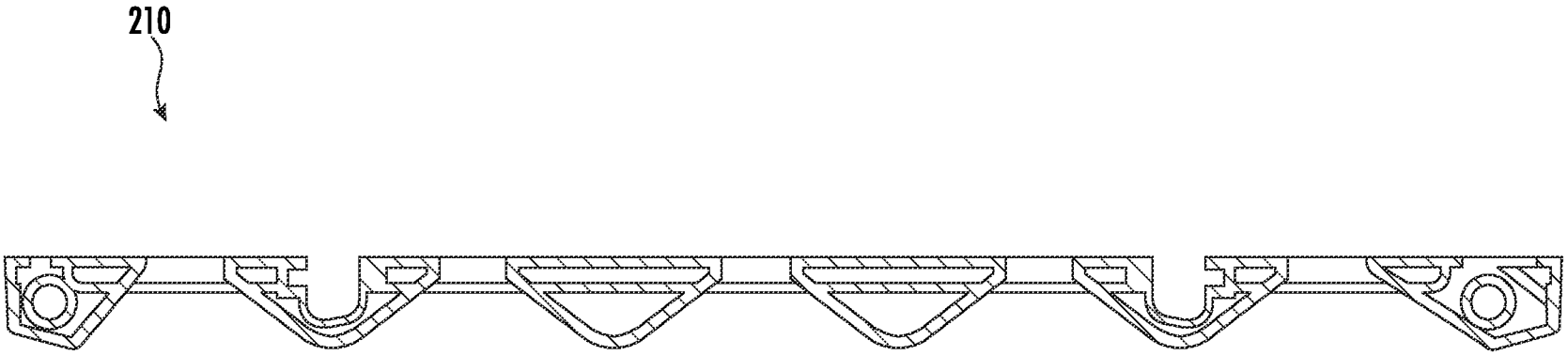
FIGS. 11A-11B illustrate cross-sectional views of one embodiment of the leading edge of the bottom frame of FIG. 6A take along line 219 of FIG. 7B, consistent with embodiments of the present disclosure.
Figure 11B:
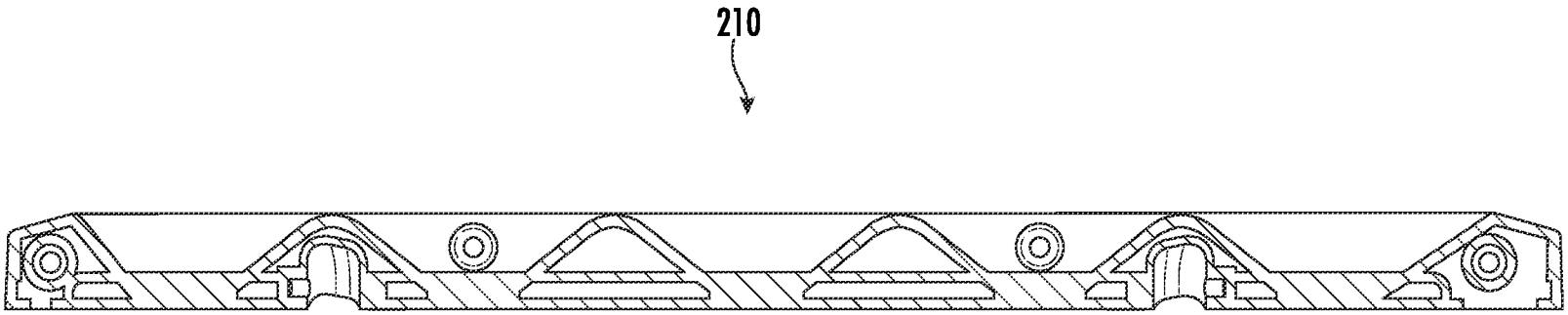

With this in mind, FIG. 1 generally illustrates an isometric view of a nozzle 100. FIG. 2 generally illustrates a front view of a nozzle 100 of FIG. 1. FIG. 3 generally illustrates a side view of a nozzle 100 of FIG. 1. FIG. 4 generally illustrates a side view of a bottom cleaner nozzle 100 of FIG. 1. FIG. 5 generally illustrates a side view of a bottom perspective cleaner nozzle 100 of FIG. 1.

It should be understood that the nozzle 100 shown in FIGS. 1-5 is for exemplary purposes only and that a vacuum cleaner consistent with the present disclosure may not include all of the features shown in FIGS. 1-5, and/or may include additional features not shown in FIGS. 1-5.

As shown, the nozzle 100 include a body or housing 130 that at least partially defines/includes one or more agitator chambers 122. The agitator chambers 122 include one or more openings (or air inlets) defined within and/or by a portion of the bottom surface/plate 105 of the housing 130. At least one rotating agitator or brush roll 180 is configured to be coupled to the nozzle 100 (either permanently or removably coupled thereto) and is configured to be rotated about a pivot axis within the agitator chambers 122 by one or more rotation systems. The rotation systems may be at least partially disposed in the vacuum head 100, and include one or more motors, e.g., AC and/or DC motors, coupled to one or more belts and/or gear trains for rotating the agitators 180.

The nozzle 100 couples to a debris collection chamber (not shown) such that the same is in fluid communication with the agitator chamber 122 to draw in and store debris collected by the rotating agitator 180. The agitator chamber 122 and debris chamber fluidly couple to a vacuum source (e.g., a suction motor or the like) for generating an airflow (e.g., partial vacuum) in the agitator chamber 122 and debris collection chamber to thereby suck up debris proximate to the agitator chamber 122 and/or agitator 180.

The rotation of the agitator 180 operates to agitate/loosen debris from the cleaning surface. Optionally, one or more filters may be disposed within the nozzle 100 (or other suitable location of a vacuum) to remove debris (e.g., ultra-fine debris such as dust particles or the like) entrained in the vacuum air flow.

The debris chamber, vacuum source, and/or filters may be at least partially located in the nozzle 100. Additionally, one or more suction tubes, ducts, or the like 136 may be provided to fluidly couple the debris chamber, vacuum source, and/or filters to the nozzle 100. The nozzle 100 may include and/or may be configured to be electrically coupled to one or more power sources such as, but not limited to, an electrical cord/plug, batteries (e.g., rechargeable, and/or non-rechargeable batteries), and/or circuitry (e.g., AC/DC converters, voltage regulators, step-up/down transformers, or the like) to provide electrical power to various components of the nozzle 100 such as, but not limited to, the rotation systems and/or the vacuum source.

The housing 130 further includes a top surface 102 and a front (or leading) edge 101. Air flows past the front edge 101 and into the agitator chamber 122. Recesses or castellations 110 are provided along the front edge 101 of the nozzle 100. The castellations 110 provide a plurality of inlets and associated inlet paths which transition to a shared suction channel within the nozzle 100.

As shown more clearly in FIGS. 4-5, the castellations 110 are defined by a plurality of projections that extend away from the base plate 105 of the housing. Each projection includes a substantially converging (e.g., but not limited to, triangular/arrow-head, which may include two or three sides) profile with a tip of the same being disposed adjacent the leading edge 101 of the nozzle 100. Thus, each projection may be at least partially defined at least in part by two sloping edges that extend towards each other, and substantially transverse relative to the leading edge 101, such that the two sloping edges meet at an apex/point adjacent the leading edge 101. One or more of the slope edges may be linear and/or non-linear. Adjacent projections collectively define an air inlet that tapers towards a center of the nozzle 100, and importantly, towards a dirty air inlet of the same. Each air inlet therefore includes a tapered profile having a first width W1 adjacent the leading edge 101 of the nozzle that transitions to a second width W2 adjacent a center of the nozzle, with the first width W1 being greater than the second width W2. Accordingly, the castellations 110 may also be referred to as having a chamfered profile or being chamfered castellations. As discussed further below, the distance between adjacent castellations and castellation characteristics such as dimensions and surface angles can be selected to achieve a desired air flow/suction and clearance profile for target debris, e.g., cheerios.

Continuing on, the chamfered castellations 110 are provided along the leading edge 101 of the nozzle 100 to allow debris to pass through the front edge 101 to the suction channel, and ultimately, into the main body during forward and reverse strokes of the surface treatment apparatus. As further shown in FIGS. 4-5, the chamfered castellations 110 can provide projections with wheel receptacles/cavities. Wheels, e.g., wheels 111, may be then be coupled into the wheel receptacles and confined thereon. The wheels 111 and associated receptacles provided by the castellations 110 advantageously allow for the wheels 111 to be disposed at a position within the nozzle 100 that is offset away from the sides of the nozzle 100, e.g., to allow for improved edge cleaning as discussed above. Moreover, placement of the wheels 111 within the receptacles of the chamfered castellations 110 minimizes or otherwise reduces the potential for restricting air flow.

FIG. 6A-FIG. 11B illustrate an example embodiment of a bottom frame 200 of a nozzle consistent with embodiments of the present disclosure. The bottom frame 200 includes chamfered castellations 210. The chamfered castellations 210 are arranged at the leading edge of the bottom frame 200 and protrude from a lower plane 219 towards a floor surface. As discussed above, the castellations can define a wheel receptacle to receive and couple to, for instance, wheel 211.

The present disclosure has identified that multiple factors of the castellations 210 function in combination and can be selected to achieve a desired function and air flow/suction.

FIG. 12-FIG. 15 show example dimensions of a chamfered castellation 1100 consistent with embodiments of the present disclosure. One aim of the present disclosure is to balance the need to maximize air flow/suction with the ability to allow relatively large debris to enter the nozzle through the castellations 110. With this in mind, the present disclosure has identified that spacing (or the offset distance) between the castellations 1100 determines, at least in part, the overall size/dimensions of debris that can enter into the brush roll chamber. Preferably, castellation spacing is set to a predefined uniform offset distance that allows for objects about the size of cheerios to pass through the castellations.

Continuing on, castellations 1100 protrude from a face 1104 of the nozzle that is closest to the floor during operation. Each castellation 1100 has a bottom surface 1105 that is in contact or adjacent with a floor surface during operation. The overall height 1103 of the castellation 1100 is the distance from the face 1104 of the nozzle to the bottom surface 1105 of the castellation 1100. Castellation height 1103 is partially determined based on the ground clearance desired for a nozzle. Ground clearance further impacts the maximum size of debris that can pass underneath the castellation 1100 and can affect transitions over thresholds, for example.

The horizontal dimension or castellation width 1107 of any individual castellation 1100 is one factor that determines how much area the castellation 1100 will restrict. Castellation width 1107 can be determined based on, for instance, the opening width of the nozzle inlet and the spacing between each castellation 1100. Wider castellations 1100 generally increase the surface area coverage of a nozzle. The surface area coverage of the nozzle caused by the increased width 1107 of the castellations 1100 creates narrower openings in the nozzle inlet. These narrower openings cause higher air velocity through the nozzle during operation.

Castellation depth 1108 is the dimension of how far back the castellation 1100 extends from the front edge of the nozzle towards the brush roll chamber.

The angle of the front "hull" of the castellation 1100 or Hull Angle ((k) 1110 is the angle that the front of the castellation 1100 makes between its two edges. The hull angle 1110 affects how fast large debris will be able to slide into the brush roll chamber after contact with the castellation 1100. With a smaller angle 1110, a castellation 1100 generally mimics a flat blade, and the large debris can readily pass through the leading edge 1112 of the nozzle and into the brush roll chamber. However, a larger angle 1110 usually means the large debris will face more resistance when entering the brush roll chamber. Generally, a larger hull angle 1110 leads to more large debris accumulating and clogging the front inlet. Smaller hull angles 1110 may not be practical or as desirable on castellations 1100 with larger widths 1107.

Figure 16A:
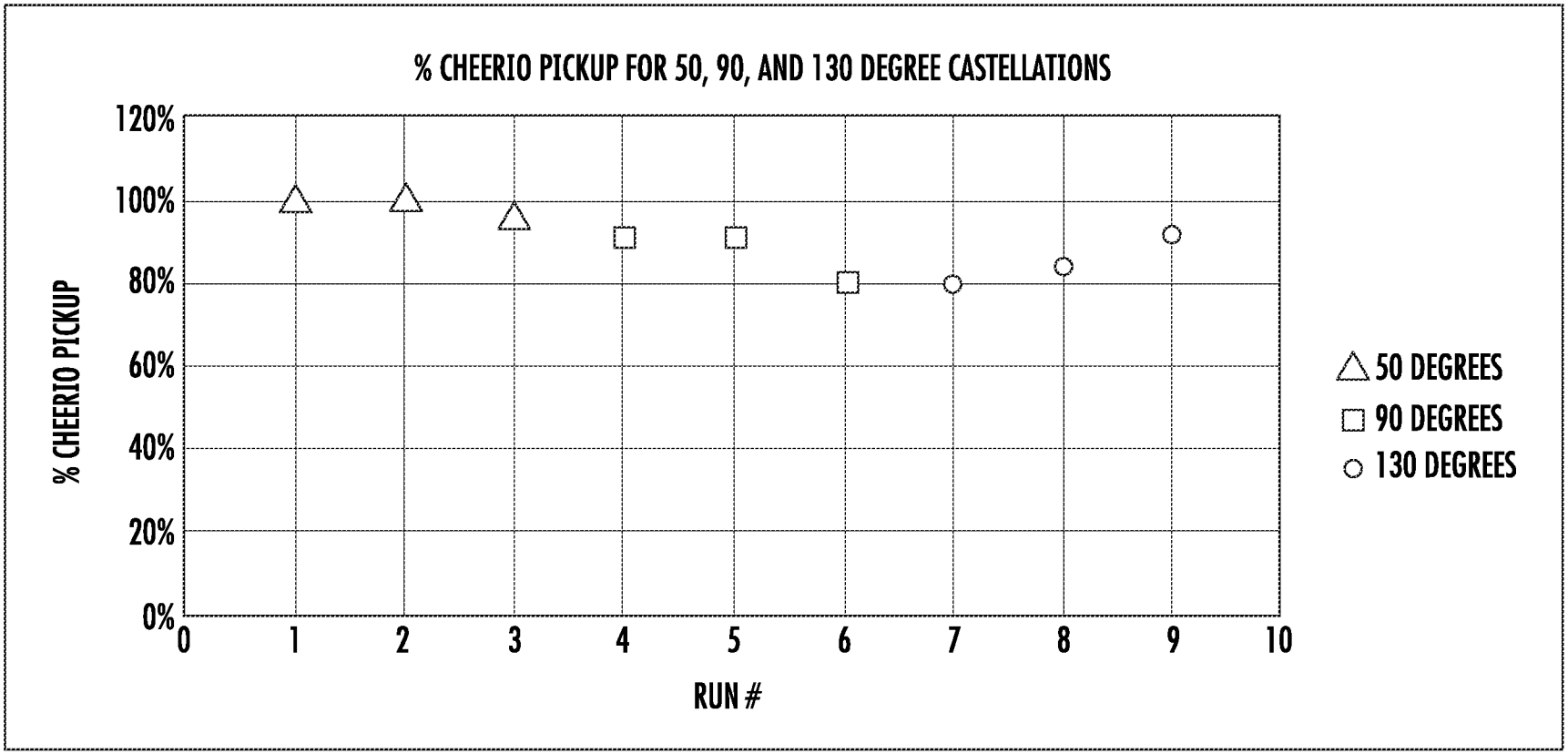
FIG. 16A is a graph illustrating large debris pickup with chamfered castellations of various hull angles.

As shown in FIG. 16A, larger hull angles may be acceptable when castellation width is large because the higher air velocity assists in evacuating large debris off of the ramp faster, which prevents or reduces the potential for clogging.

Assuming no suction or rolling motion of a cheerio when sliding down a castellation, its acceleration down the castellation can be approximated as:

$$a \approx \frac{F_{app}}{m}\left[\sin\left(90-\frac{\phi}{2}\right)-\mu\cos\left(90-\frac{\phi}{2}\right)\right] \quad \text{Equation (1)}$$

Where $F_{app}$ is the force applied by the vacuum on the cheerio.

Figure 16B:
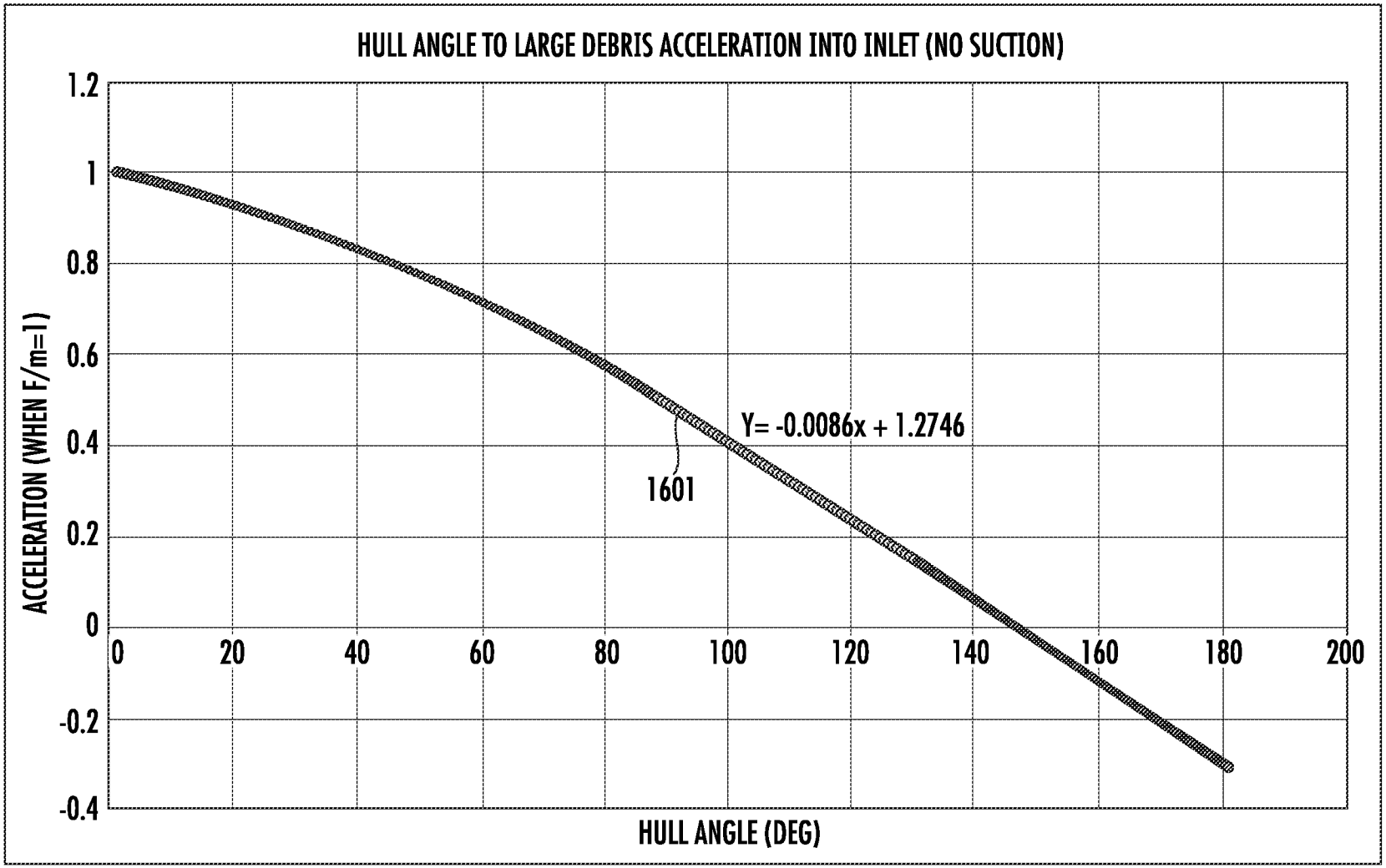
FIG. 16B is a graph illustrating the relationship between hull angle and debris acceleration in a suction nozzle with chamfered castellations.

FIG. 16B illustrates the relationship between hull angle and acceleration of the exemplar large debris. The lighter region 1601 of the line (between 90 and 130 degrees) represents the usual range of hull angles when modelling chamfered castellations. In this region 1601, acceleration decreases on average 2.8% for each hull angle degree increase, decreasing more per degree as the hull angle gets higher. Lower acceleration causes debris (e.g., cheerios) to evacuate into the brush roll chamber slower, leading to more clogs and failures in picking up debris.

Figure 12:
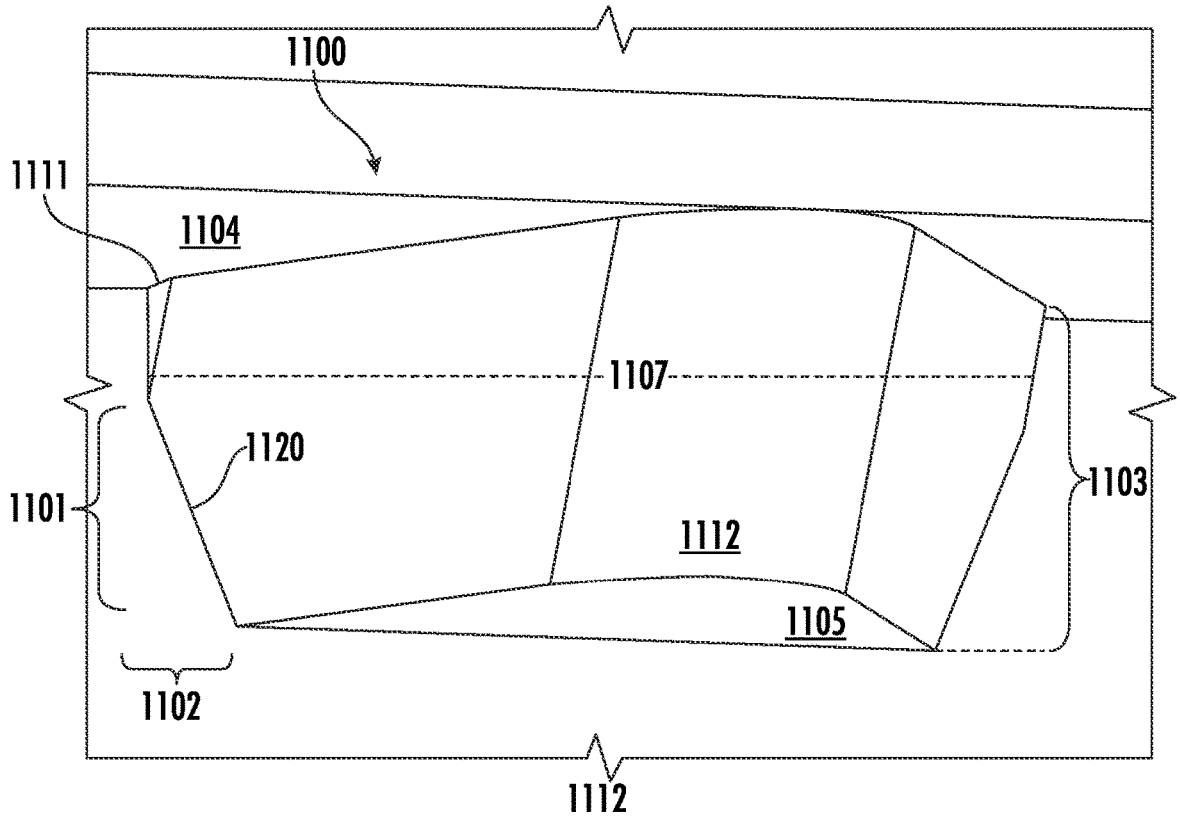
FIG. 12 illustrates a front perspective view of one embodiment of a chamfered castellation, consistent with embodiments of the present disclosure.
Figure 13:
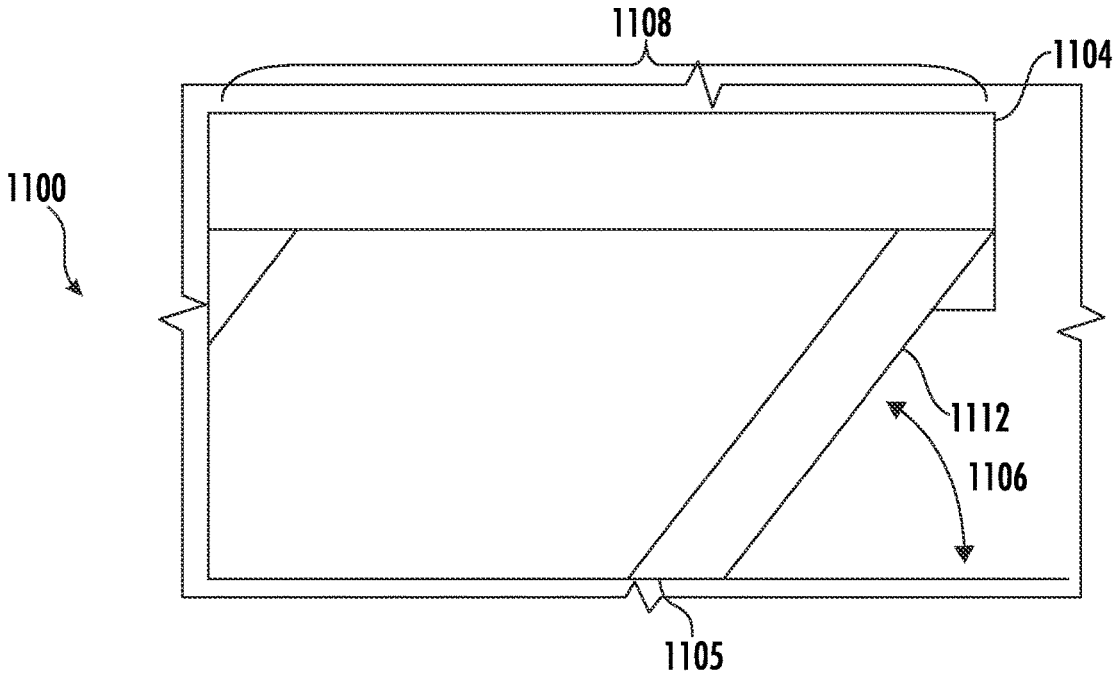
FIG. 13 illustrates a side view of one embodiment of a chamfered castellation, consistent with embodiments of the present disclosure.
Figure 14:
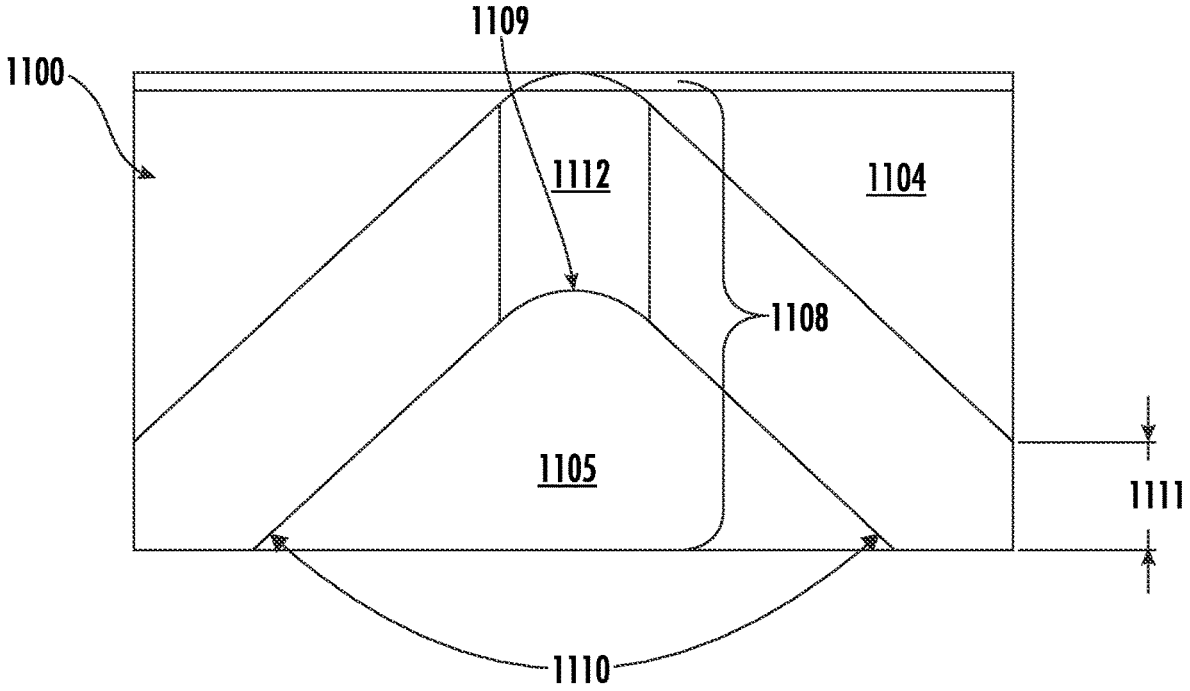
FIG. 14 illustrates a bottom perspective view of one embodiment of a chamfered castellation, consistent with embodiments of the present disclosure.
Figure 15:
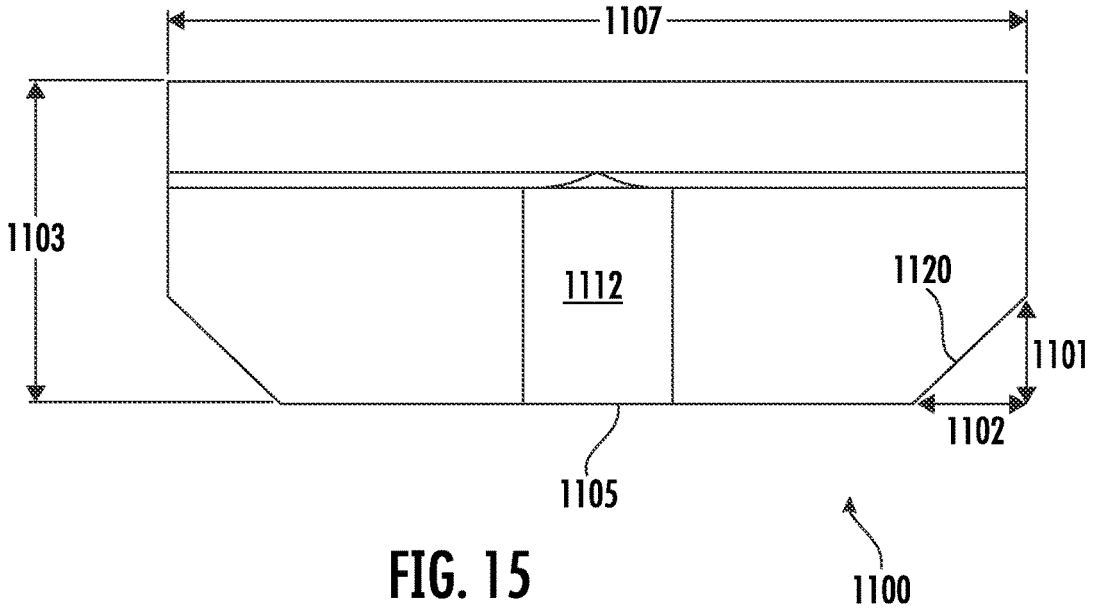
FIG. 15 illustrates a front view of one embodiment of a chamfered castellation, consistent with embodiments of the present disclosure.

In the present disclosure, the castellations 1100 are further characterized by at least one chamfer 1120 (see, e.g., FIG. 12). Chamfers 1120 can be created/formed by removing a portion of the castellation 1100, and its dimensions are then chosen to achieve nominal suction and clearance as discussed above.

Chamfers 1120 may be formed through beveled edges which are cut away from perpendicular faces. As seen in FIG. 12, chamfers 1120 that are flush with the back of the castellation 1100 generally widen the spacing at the bottom 1105 while keeping the spacing tighter at the top 1104. This increases the overall surface area restricted by the castellation and increases air velocity, while importantly still allowing passage of larger debris.

The primary dimensions of the chamfer 1120 are its horizontal (x) 1102 and vertical (y) 1101 dimensions. These dimensions 1102, 1101 help determine the size and type of debris that can get through to the brush roll chamber.

As stated above, the dimensions of the castellation 1100 affect the possible dimensions 1102, 1101 of any potential chamfer 1120.

Extrusion Angle (α) 1106 (see, e.g., FIG. 13) is the angle that the castellation 1100 makes with respect to the horizontal (side view). The extrusion angle 1106 affects both the x and the y component of the chamfer 1120.

Radius (R) 1109 (see, e.g., FIG. 14) is the radius of the front fillet on the castellation 1100, and affects primarily the x component of the chamfer. The radius 1109 affects primarily the x component of the chamfer.

Castellation height 1103 (see, e.g., FIG. 12) affects both the x and the y component of the chamfer 1120.

Castellation width 1107 affects primarily x component of the chamfer 1120.

Castellation depth 1108 affects primarily the x component of the chamfer 1120.

Hull angle 1110 affects primarily the x component of the chamfer 1120.

Offset (O) 1111 (see, e.g., FIGS. 12 and 14) is the distance that the angled walls of the castellation are shifted towards the front of the plate.

With standard castellations, the determination of the spacing between castellations is straightforward and can be based on factors such as the size of the debris that needs to pass through a suction nozzle.

For instance, if a maximum dimension of a debris to be picked up, is 13.95 mm, then in a non-chamfered castellations, a minimum spacing of about 13.95 mm is required. Moreover, testing suggests that an additional 2 mm clearance reduces clogging at the intake nozzle. Testing and simulation has shown that additional clearance space does not further reduce clogging of debris at the nozzle and lowers air velocity through the nozzle. Therefore, spaces of 16 mm+−2 mm between each castellation allows passage of the target debris size without clogging while also benefiting from the increased air velocity from castellations.

Figure 17A:
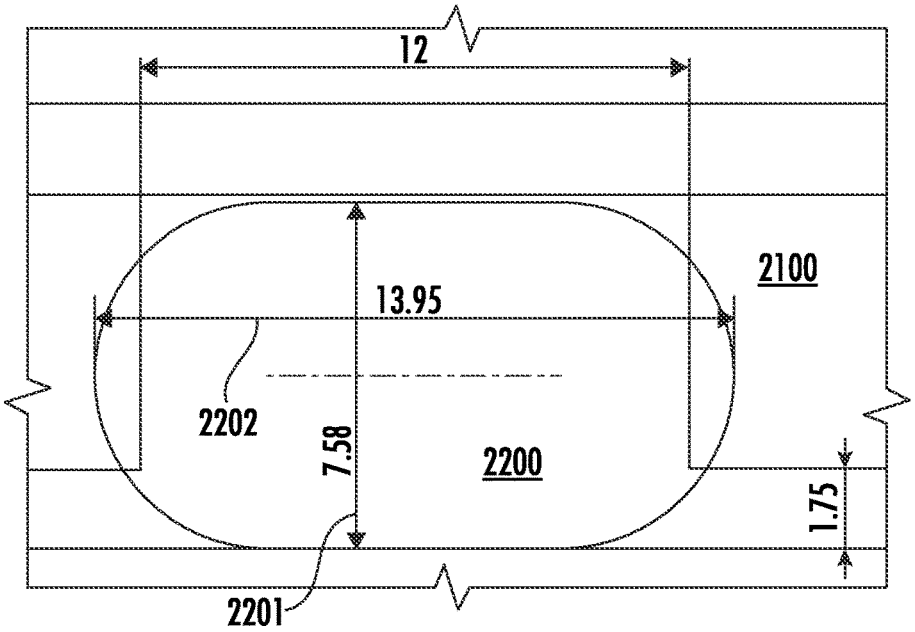
FIG. 17A and FIG. 17B are schematic diagrams that illustrate nozzles with castellations as the nozzles encounter large debris, consistent with embodiments of the present disclosure.
Figure 17B:
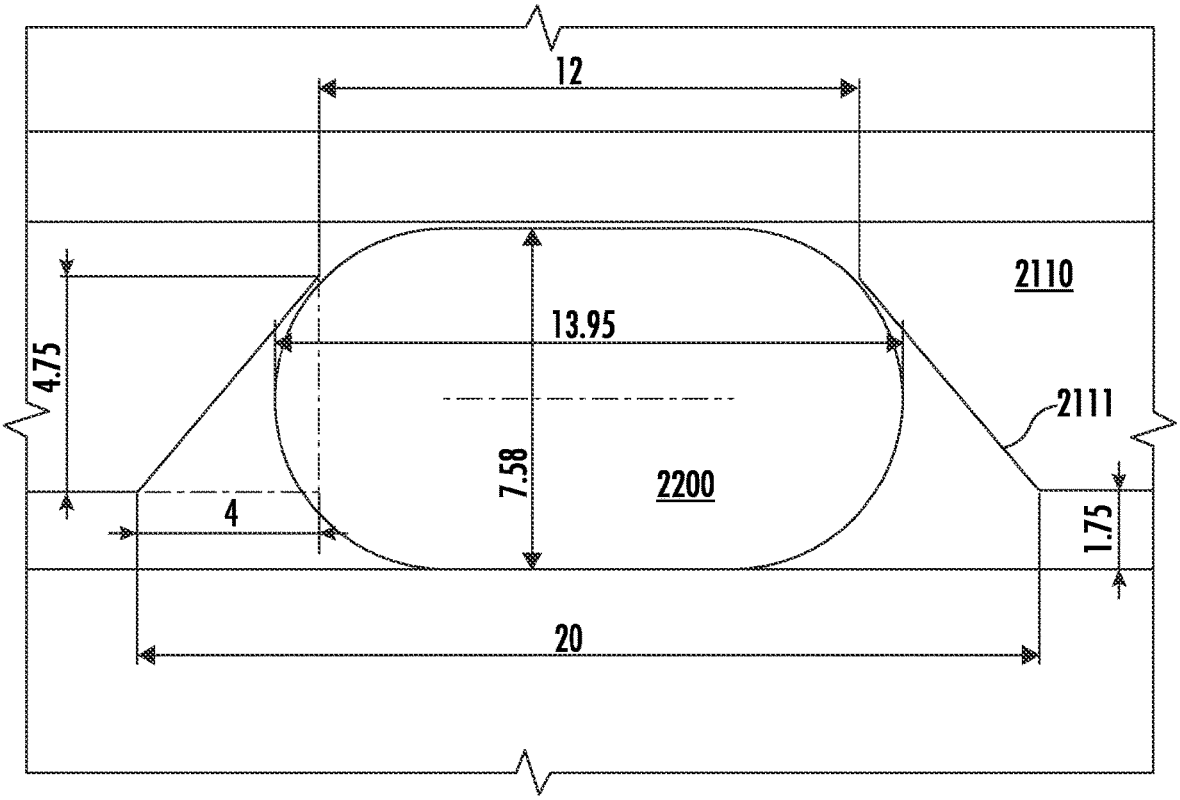

FIG. 17A and FIG. 17B are schematic diagrams that illustrate nozzles with castellations as the nozzles encounter large debris. FIG. 17A illustrates a standard castellation 2100 without one or more chamfers. FIG. 17B illustrates a chamfered castellation 2110. A large debris 2200, for example a cheerio, cannot pass through the castellations 2100 shown in FIG. 17A, but a piece of debris with the same dimensions is able to pass through the chamfered castellations 2110 of FIG. 17B because of the increased spacing provided by the chamfer 2111.

FIG. 17A shows castellations 2100 with no chamfer and spacing of 12 mm. The example large debris 2200 has a height 2201 of 7.58 mm and an outer diameter 2202 of 13.95 mm.

FIG. 17B shows a castellation 2110 with a 4 mm×4.75 mm chamfer 2111 with spacing of 12 mm. The x dimension of the chamfer 2111 extends the spacing to 20 mm at the bottom. However, the use of the chamfer 2111 retains 29 $mm^2$ of inlet area per space as opposed to no chamfers with 20 mm spacing. Thus larger debris is picked up without the decrease in air velocity caused by castellations with 20 mm spacing.

Just as the size of debris to be picked up is used to determine spacing for a standard castellation, the dimensions of debris 2201, 2202 can be used to determine the dimensional components of a chamfer 2111. In addition to the width 2202, the height 2201 of a piece of debris may be used to calculate the vertical component of the chamfer 2111. After the desired height has been calculated, the following formula may be used to determine the initial y component of the chamfer:

$$y = \text{height} - \text{ground clearance} \quad \text{Equation (2)}$$

The x component of the chamfer should be preferably selected such that it creates the desired spacing without chamfers at the midpoint of the chamfer. Thus, the initial desired spacing for castellations is located in the middle of the space. For example, as mentioned above, when determining spacing without chamfers, 16 mm spacing was used to pick up 100% of debris with an outer dimension of 13.95 mm.

Figure 18:
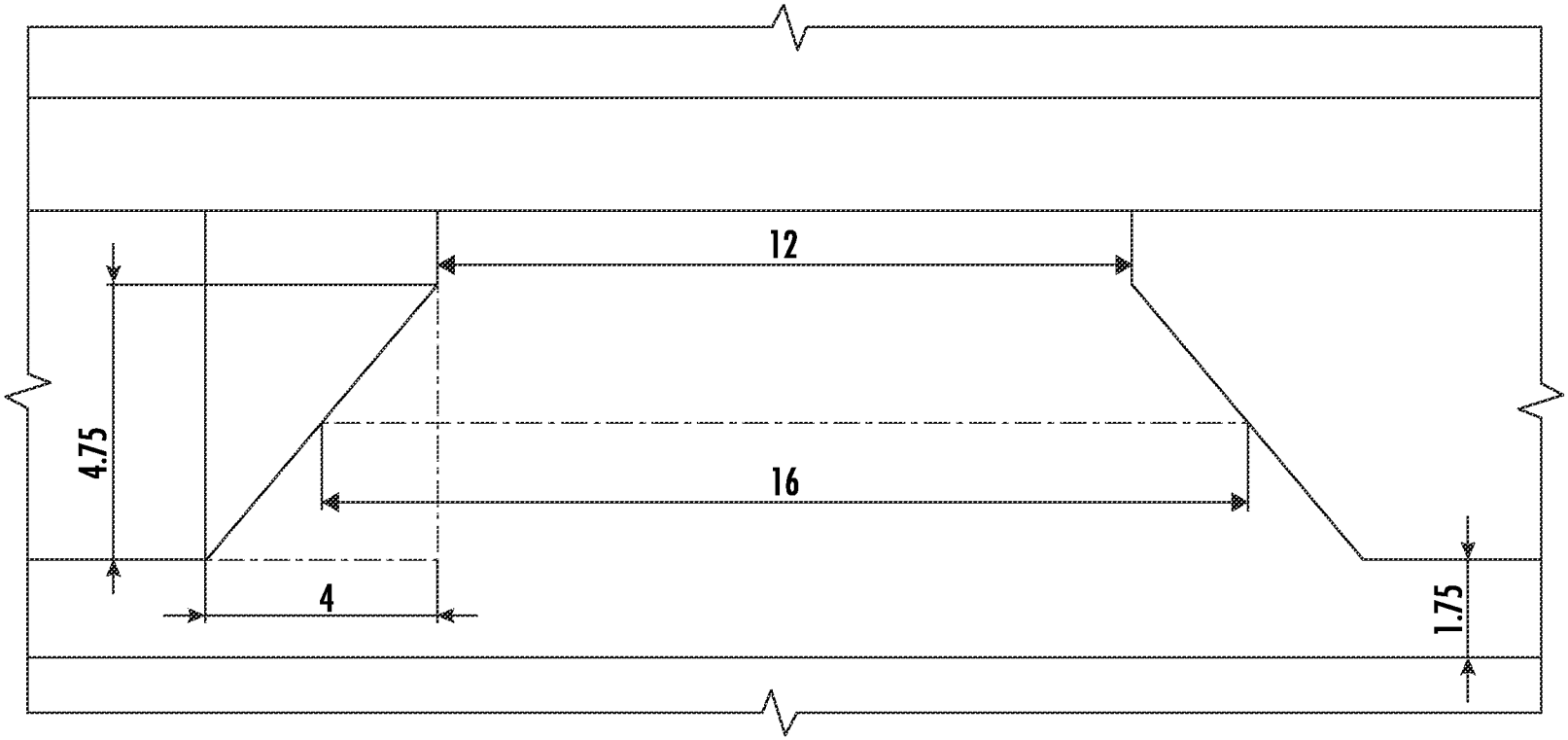
FIG. 18 illustrates a front view of one embodiment of a space between chamfered castellations, consistent with embodiments of the present disclosure.
Figure 19A:
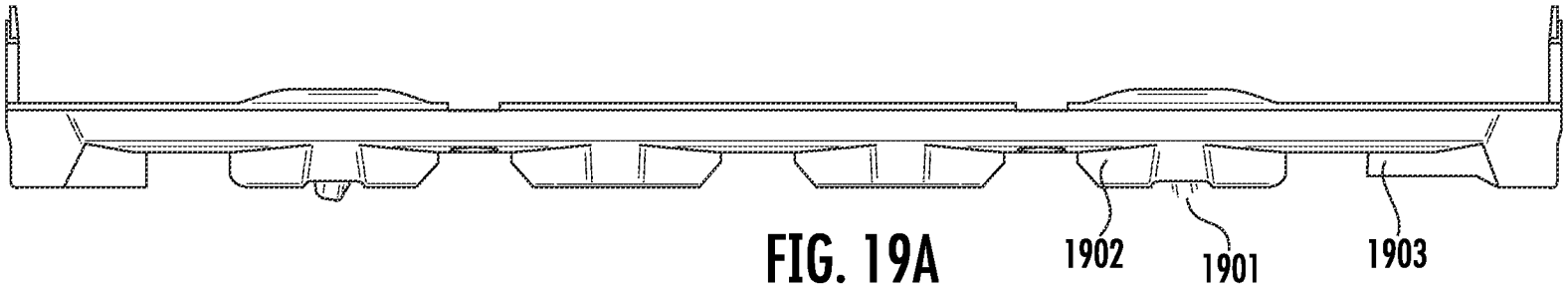
FIG. 19A is a front view of the leading edge of a vacuum cleaner nozzle with chamfered castellations and cambered wheels, consistent with embodiments of the present disclosure.
Figure 19B:
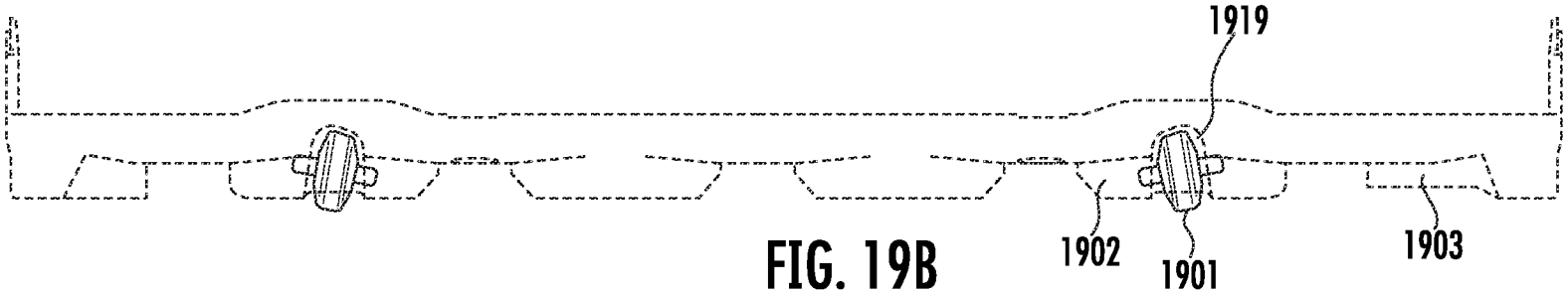
FIG. 19B is a semi-transparent view of the leading edge of a vacuum cleaner nozzle FIG. 19A, showing the cambered wheels within the chamfered castellations.
Figure 19C:
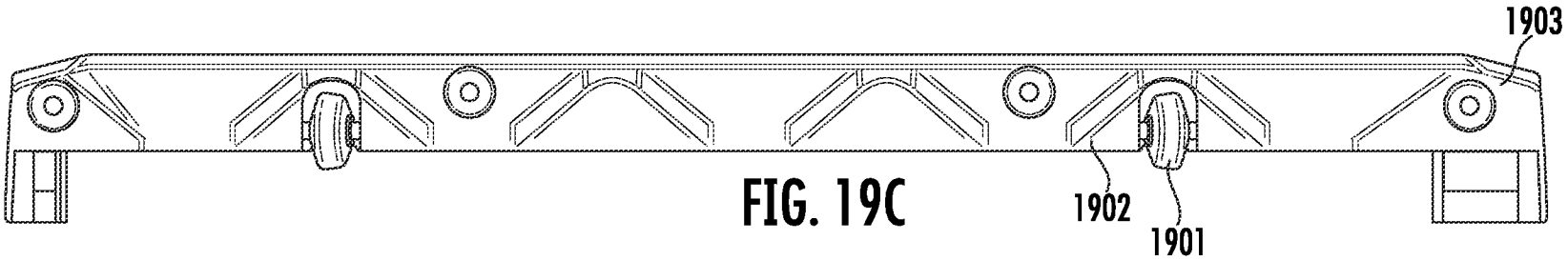
FIG. 19C illustrates a bottom view of the semi-transparent leading edge of a vacuum cleaner nozzle of FIG. 19B, consistent with embodiments of the present disclosure.
Figure 19D:
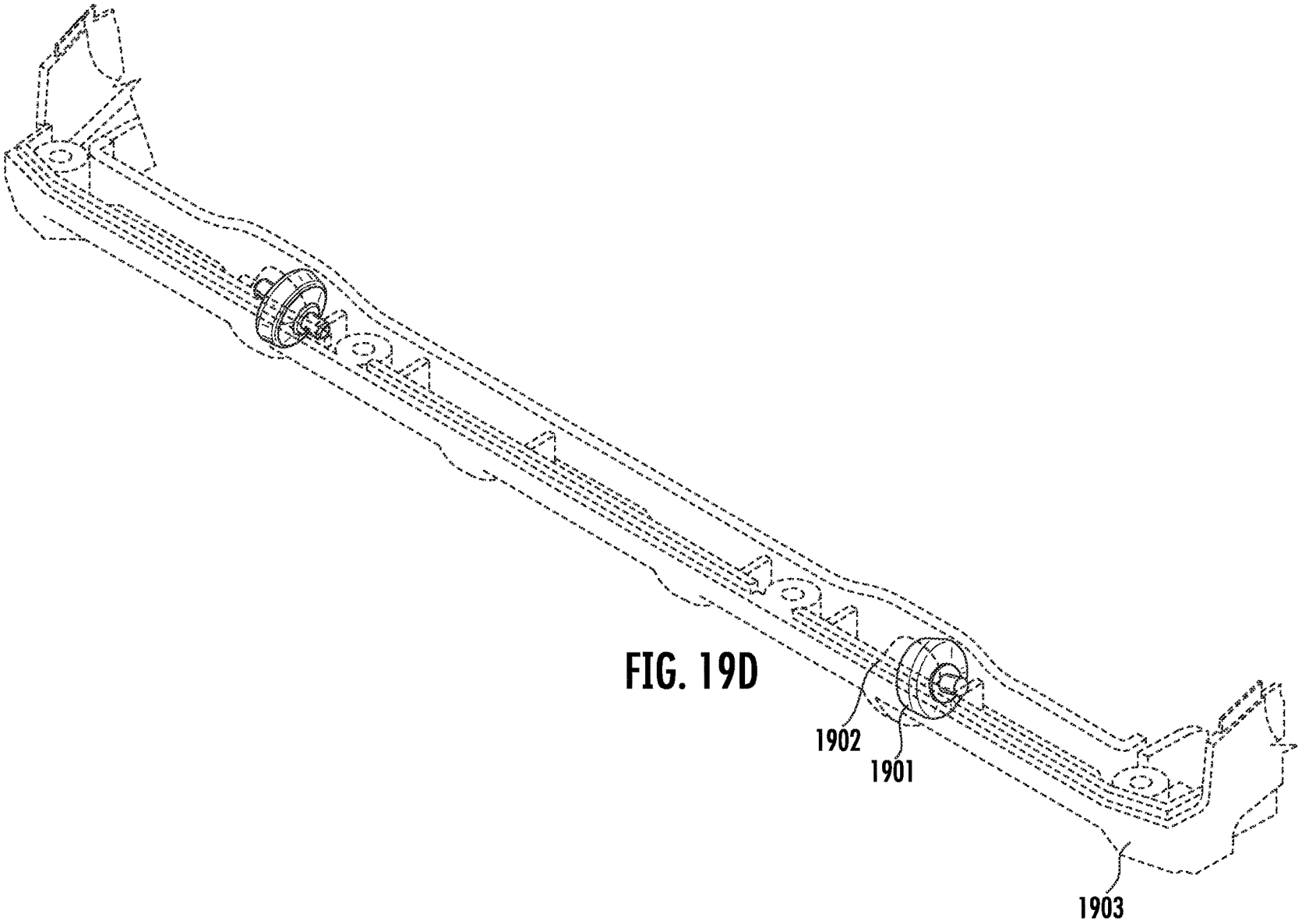
FIG. 19D illustrates an isometric view of the semi-transparent leading edge of a vacuum cleaner nozzle of FIG. 19B, consistent with embodiments of the present disclosure.

As illustrated in FIG. 18, if a line is extended between two castellation chamfers at the midpoint of the chamfer's hypotenuse, this value should equal whatever nominal spacing was initially calculated without the use of a chamfer. In the present embodiment, a 4 mm×4.75 mm chamfer is used on top of a 12 mm wide spacing to create a 16 mm space at the midpoint of the chamfer.

Once the requirements of a castellation for a suction nozzle are determined, the following dimensions can be determined:

Chamfer Dimensions: x and y

Castellation Height: H (usually determined based on the suction nozzle requirements)

Extrusion Angle: α (45° may be used for initial calculations, but can be increased or decreased to achieve a desired radius)

Castellation Depth: D (determined based on the suction nozzle requirements)

Castellation Width: W (determined from front inlet width, spacing, and number of castellations)

Using the above dimensions, the following measurements may be calculated for chamfered castellations: Offset (O), Extrusion Length (E), Hull Angle (ϕ), and Radius (R).

$$E = \frac{H}{\sin\alpha} \quad \text{Equation (3)}$$

$$\phi = 2 * \tan^{-1}\left(\frac{x(H-y)}{Oy}\right) \quad \text{Equation (4)}$$

$$R = \frac{\frac{W}{2} - \left[(D-O)\tan\frac{\phi}{2}\right]}{\tan\left(45 - \frac{\phi}{4}\right)} \quad \text{Equation (5)}$$

The calculated dimensions may be used to construct chamfered castellations that allow the targeted debris to pass through the suction nozzle. Further considerations including aesthetics and structural support may dictate additional castellations characteristics.

As seen in FIGS. 19A-19D, some embodiments further include one or more wheels 1901 placed within one or more chamfered castellations 1902, e.g., within the aforementioned wheel receptacles/cavities, such that the wheels 1901 are located away from the sides of the nozzle. Thus, the dimensions of the castellation must allow the inclusion of the wheels.

During operation of a vacuum cleaner, wheels 1901 that proceed the suction inlet are exposed to debris. In order to prevent wheel clogging with debris, the leading edge of a suction nozzle preferably entirely encloses/surrounds the one or more wheels 1901 (e.g., leading edge of the one or more wheels 1901). If the one or more wheels 1901 are located on the lateral sides of the suction nozzle, then the enclosure of the wheel by the suction nozzle constraints the ranges of shapes for the side castellations 1903. Furthermore, the side castellations 1903 may need to accommodate other hardware such as attachment points, leaving relatively small amount of room for the one or more wheels 1901. In the present embodiment, the side castellations 1903 allow for improved edge cleaning without having to necessarily accommodate wheels.

Figure 20A:
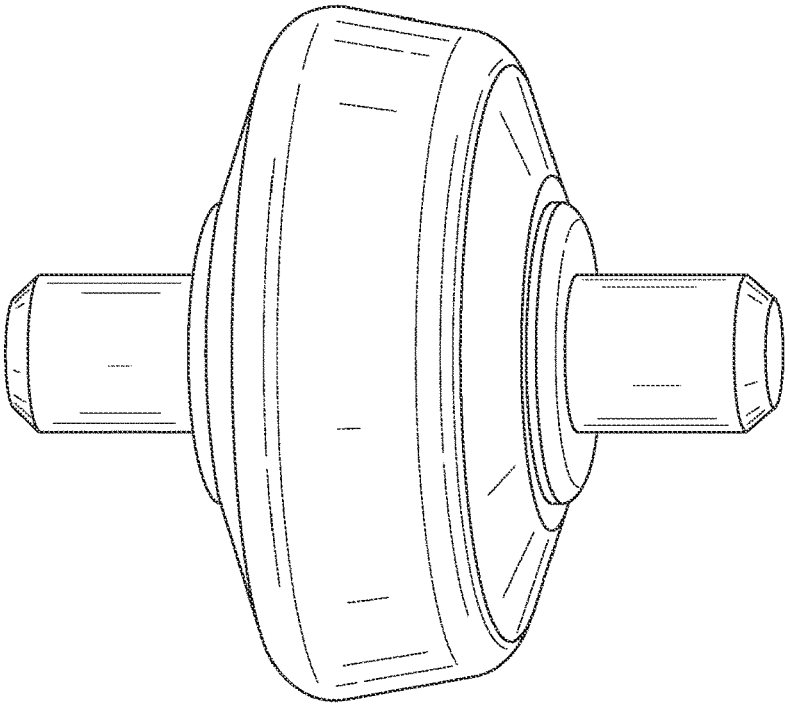
FIG. 20A is a front view of a cambered wheel, consistent with embodiments of the present disclosure.
Figure 20B:
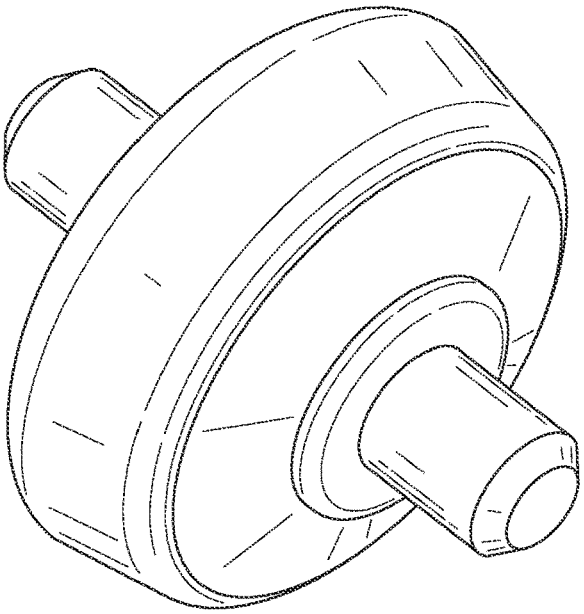
FIG. 20B is an isometric view of a cambered wheel, consistent with embodiments of the present disclosure.

As shown in FIGS. 20A-20B, the one or more wheels shown in FIGS. 19A-19D may be cambered wheels. Camber is the angle at which the wheel stands relative to the floor. In the present embodiment, the wheels have a static negative camber, that the top of each wheel is leaned in closer to the center of the suction nozzle when not in motion. Camber angle alters the handling qualities of a particular suspension design; in particular, negative camber improves grip while in motion. In general, each wheel operates independently and rolls in an arc. When both wheels have symmetrical negative camber, the lateral forces substantially cancel each other out. Thus a user can easily steer the cleaning device during operation, and there is an improved perception of control due to the increased "grip."

In addition to the perception of control, the noise generated during the operation of a vacuum cleaner can have a significant impact on user experience. Increased noise, particularly noise not associated with a suction motor, is seen as a negative and undesirable quality. Wheel chatter, that is the noise created by the wheels of the vacuum cleaner during operation, should be reduced as much as possible. The cambered wheels in the present embodiment allow for decreased wheel chatter during operation.

The cambered wheels generate force substantially perpendicular to the direction of travel. This forces results in the cambered wheels being pushed into the wheel housings on the nozzle. Since one of the sources of wheel chatter noise is the knocking of wheels against the housing, cambered wheels limit the range of motion of the wheels relative to the housing.

Figure 21:
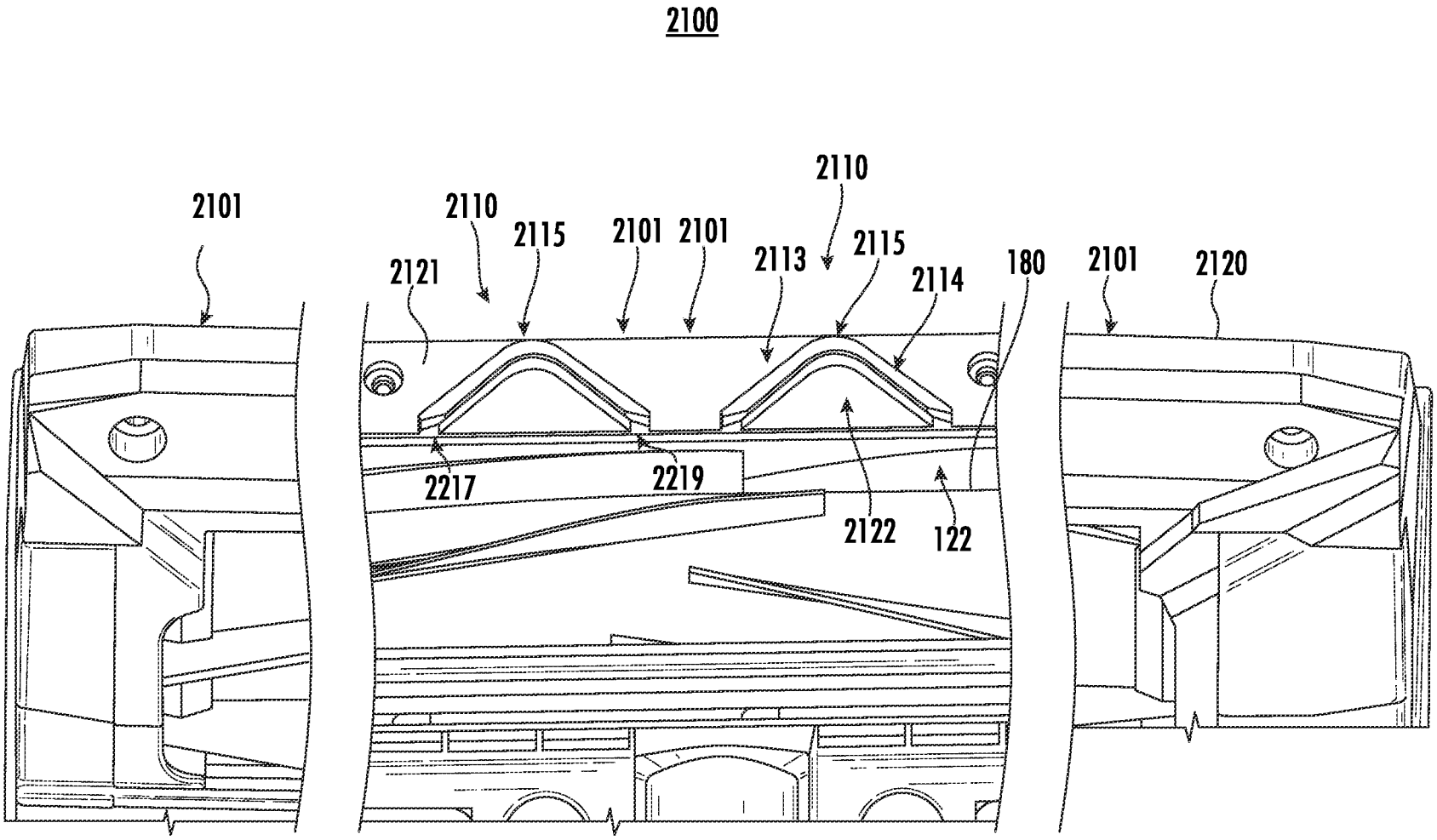
FIG. 21 is a bottom partial view of another nozzle, consistent with embodiments of the present disclosure.

With reference now to FIG. 21, another example of a nozzle 2100 including one or more castellations 2110 consistent with the present disclosure is generally illustrated. As described herein, the castellations 2110 may include a substantially converging (e.g., but not limited to, triangular/arrow-head, which may include two or three sides) profile with a tip 2115 of the same being disposed adjacent the leading edge 2101 of the nozzle 2100. The castellations/projections 2110 may be at least partially defined at least in part by two sloping edges/walls 2113, 2114 that extend towards each other, and substantially transverse relative to the leading edge 2101, such that the two sloping edges/walls 2113, 2114 meet at an apex/point/tip 2115 adjacent the leading edge 2101. One or more of the slope edges/walls 2113, 2114 may be linear and/or non-linear. One or more of the castellations/projections 2110 may be considered to have a hollow back. As used herein, the term "hollow back" is intended to mean that the castellation 2110 does not include a portion that couples/connects the distal ends 2117, 2119 of the two sloping edges/walls 2113, 2114 (e.g., the ends 2117, 2119 of the two sloping edges/walls 2113, 2114 generally opposite the apex/point 2115). As such, a hollow back castellation 2110 does not a rear wall that couples/connects the distal ends of the two sloping edges/walls 2113, 2114. The hollow back castellation 2110 and the housing 2120 (e.g., the sole plate 2121) may therefore define a recess and/or cavity 2122 that is exposed (e.g., directly fluidly coupled) to the air flow into the agitation chamber 122.

Figure 22:
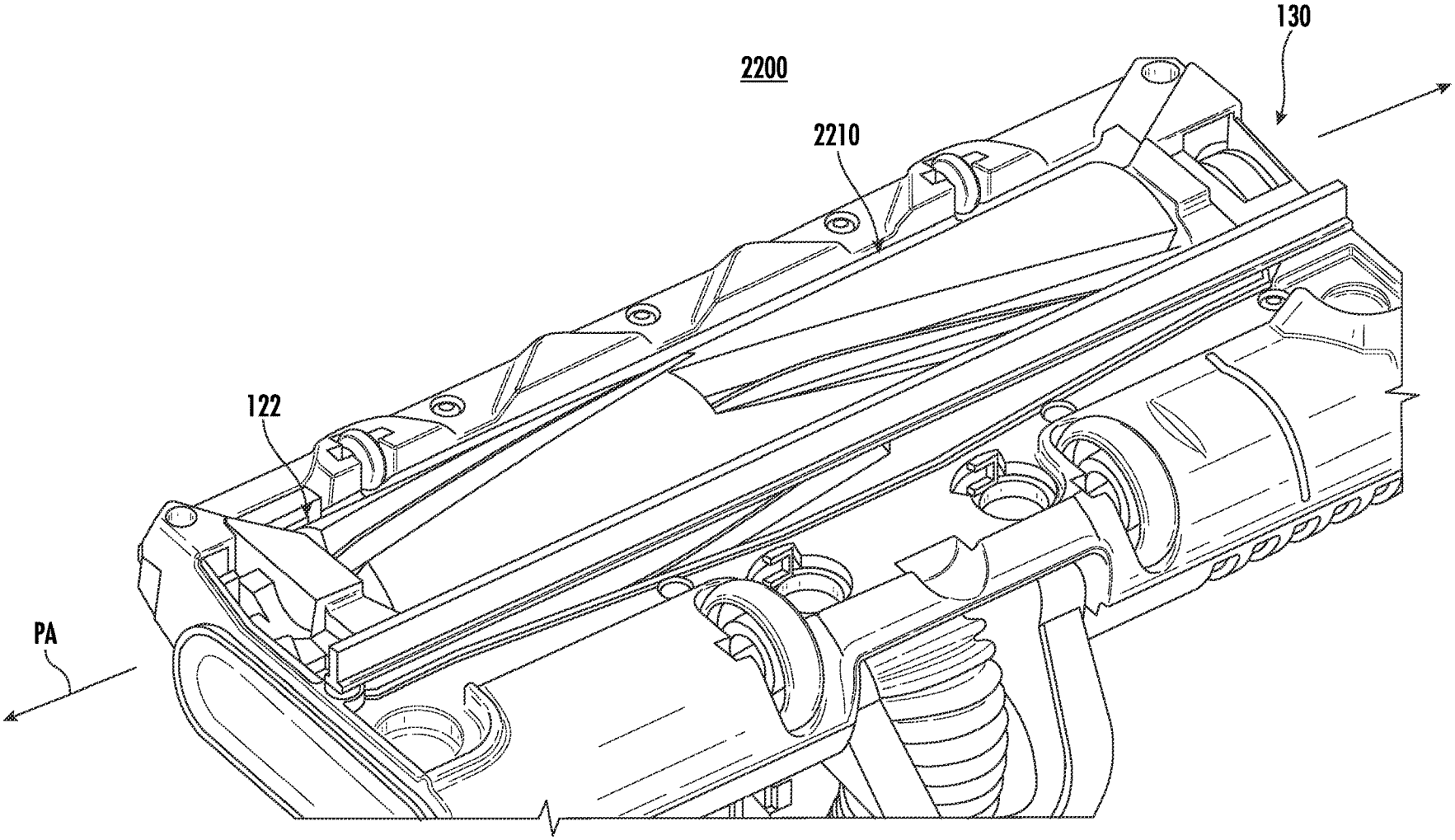
FIG. 22 is a bottom view of yet another nozzle, consistent with embodiments of the present disclosure.
Figure 23:
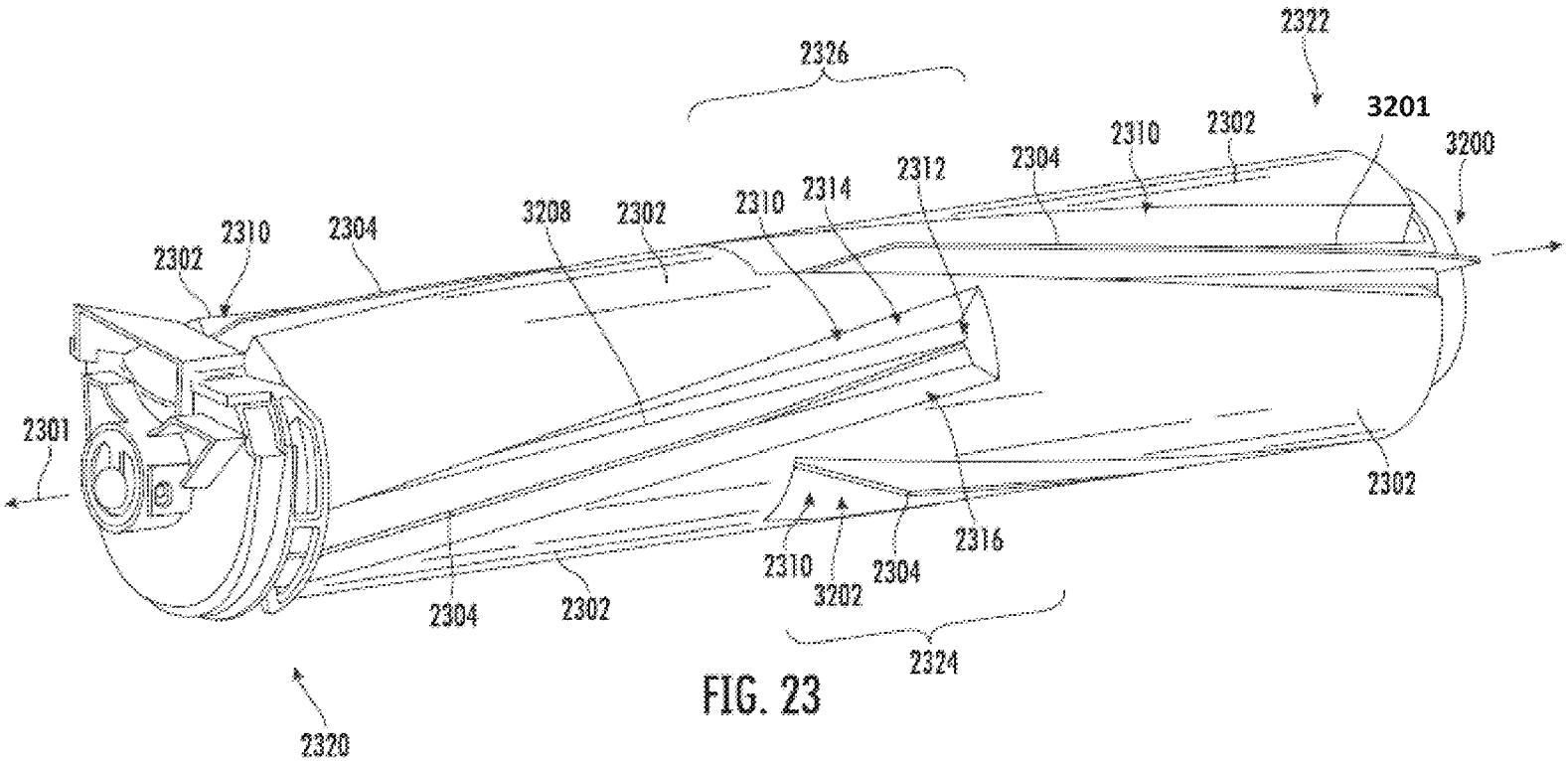
FIG. 23 is a perspective view of the agitator of FIG. 22, consistent with embodiments of the present disclosure.
Figure 24:
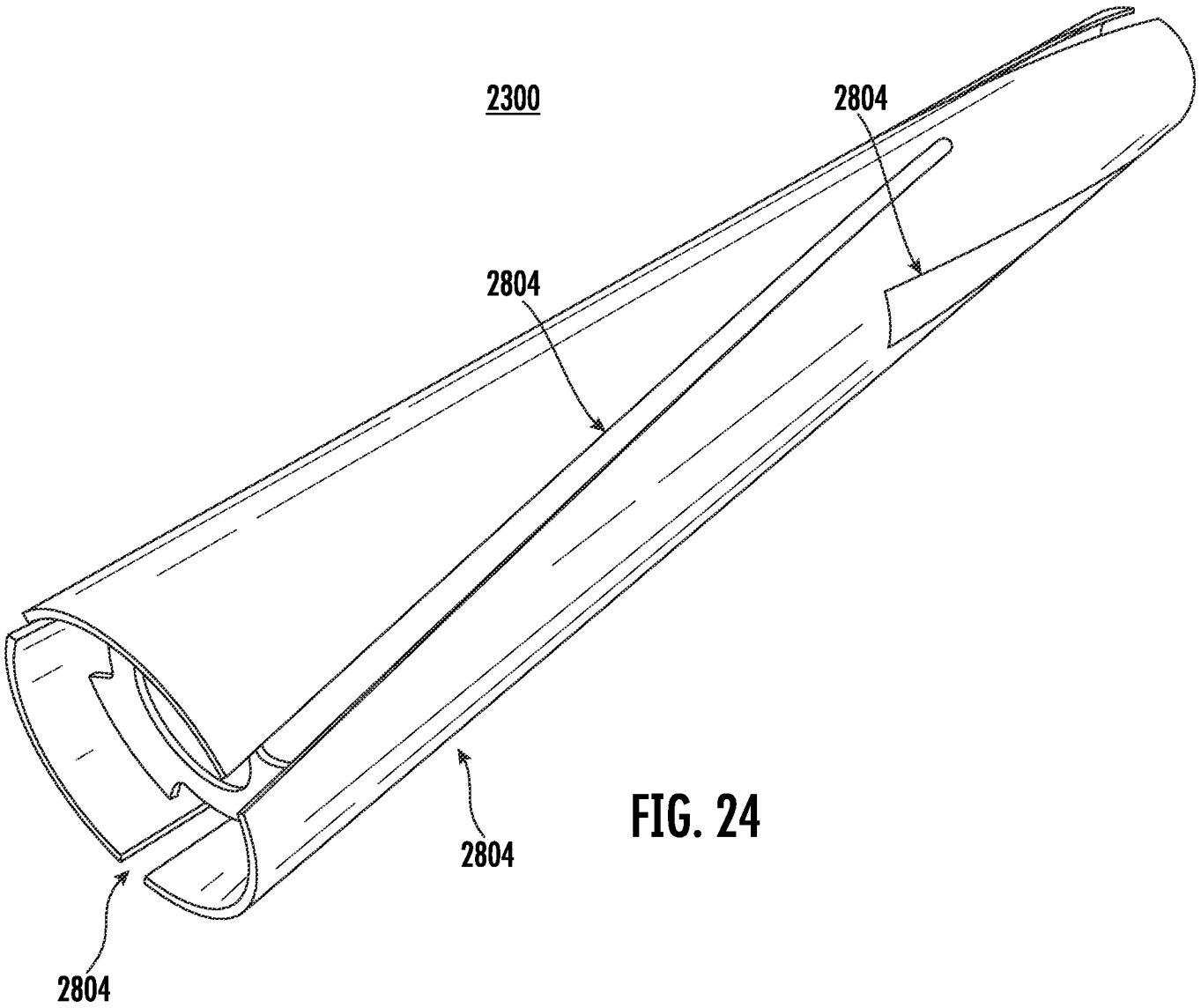
FIG. 24 is a perspective view of the elongated main body of the agitator of FIG. 23, consistent with embodiments of the present disclosure.

Turning now to FIG. 22, another example of a nozzle 2200 including one or more agitators 2210 is generally illustrated, which may be an example of the agitator 180 of FIG. 4. The agitator 2210 may be rotatably disposed within one or more agitation chamber 122 formed in housing/body 130 as generally described herein. With reference to FIG. 23, the agitator 2210 is shown removed from the nozzle 2200. The agitator 2210 may include an elongated body or core 2300 having a long axis 2301 extending along the pivot axis PA (FIG. 22) of the agitator 2210. The elongated body or core 2300 may be formed from a substantially rigid material configured to allow the agitator 2210 to be rotated within the agitator chamber 122. The elongated body or core 2300 may have a generally cylindrical shape (see, e.g., FIG. 24) or may have a tapered design as described in U.S. Ser. No. 16/656,930, filed Oct. 18, 2019, which is fully incorporated herein by reference. As can be seen, the agitator 2210 includes at least one soft cleaning feature 2302 and at least one resiliently deformable flap 2304 (which may be an example of a sidewall) disposed within at least one channel and extending helically around and radially outward from at least a portion of an elongated main body 2300 of the agitator 2210 in a direction along a longitudinal axis 2806 of the agitator 2210. As described herein, the agitator 2210 may generally be regarded as a fuzzy roller with a soft material forming at least one channel and at least one resiliently deformable flap disposed therein.

The soft cleaning feature 2302 may include a plush, dense pile formed from relatively flexible filaments/material (e.g., but not limited to, a velvet or velvet-like material). The pile may be similar to the raised or fluffy surface of a carpet, rug or cloth, and comprises filaments woven on to a fabric carrier member (not shown) attached to the elongated main body 2300, for example using an adhesive. The length of the filaments of the pile may be in the range from 5 to mm. The fabric carrier may be in the form of a strip wound on to the elongated main body 2300 so that the pile is substantially continuous, substantially covering the outer surface of the elongated main body 2300 as described herein. Alternatively, the carrier member may be in the form of a cylindrical sleeve into which the elongated main body 2300 is inserted.

The pile material may include synthetic fibers such as nylon, polyester, petroleum-based acrylic or acrylonitrile, natural fibers (such as wool or animal fur), or wood pulp-based rayon, and/or from blended fibers. The nap or pile of the soft cleaning feature 2302 may be configured to agitate and/or transport debris towards the opening of the nozzle 2200. Due to the softness of the pile/nap, the soft cleaning feature 2302 may dampen vibration, absorb sound, and/or reduce damage (e.g., scratching) to the floor surface (e.g., but not limited to, hardwood floors or the like). By way of non-limiting examples, the soft cleaning feature 2302 may have a density of 5000-8250 grams/cm, for example, 6600 grams/cm. The pile of the soft cleaning feature 2302 may extend approximately 2-10 cm from the elongated body or core 2300, for example, 7 mm.

The agitator 2210 may include one or more channels 2310 with at least one resiliently deformable flap 2304 at least partially disposed therein. The channels 2310 may be configured to allow the resiliently deformable flap 2304 to move forward and backwards as the agitator 2210 rotates. In at least one example, the channel 2310 may have width proximate the opening that is approximately 6-12 mm wide (front to back), for example, approximately 8 mm.

Figure 25:
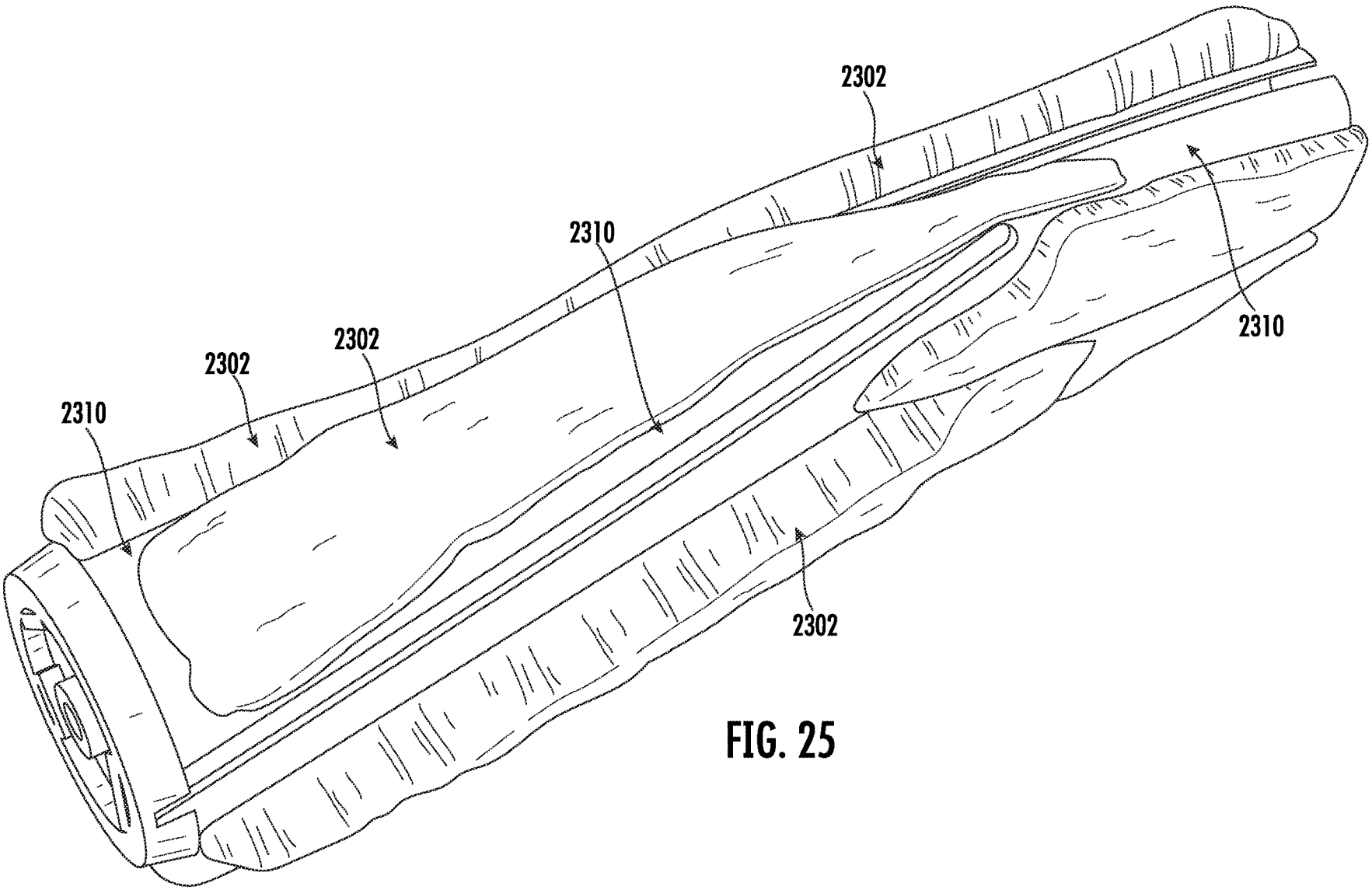
FIG. 25 is a partially assembled view of the agitator of FIG. 23, consistent with embodiments of the present disclosure.
Figure 26:
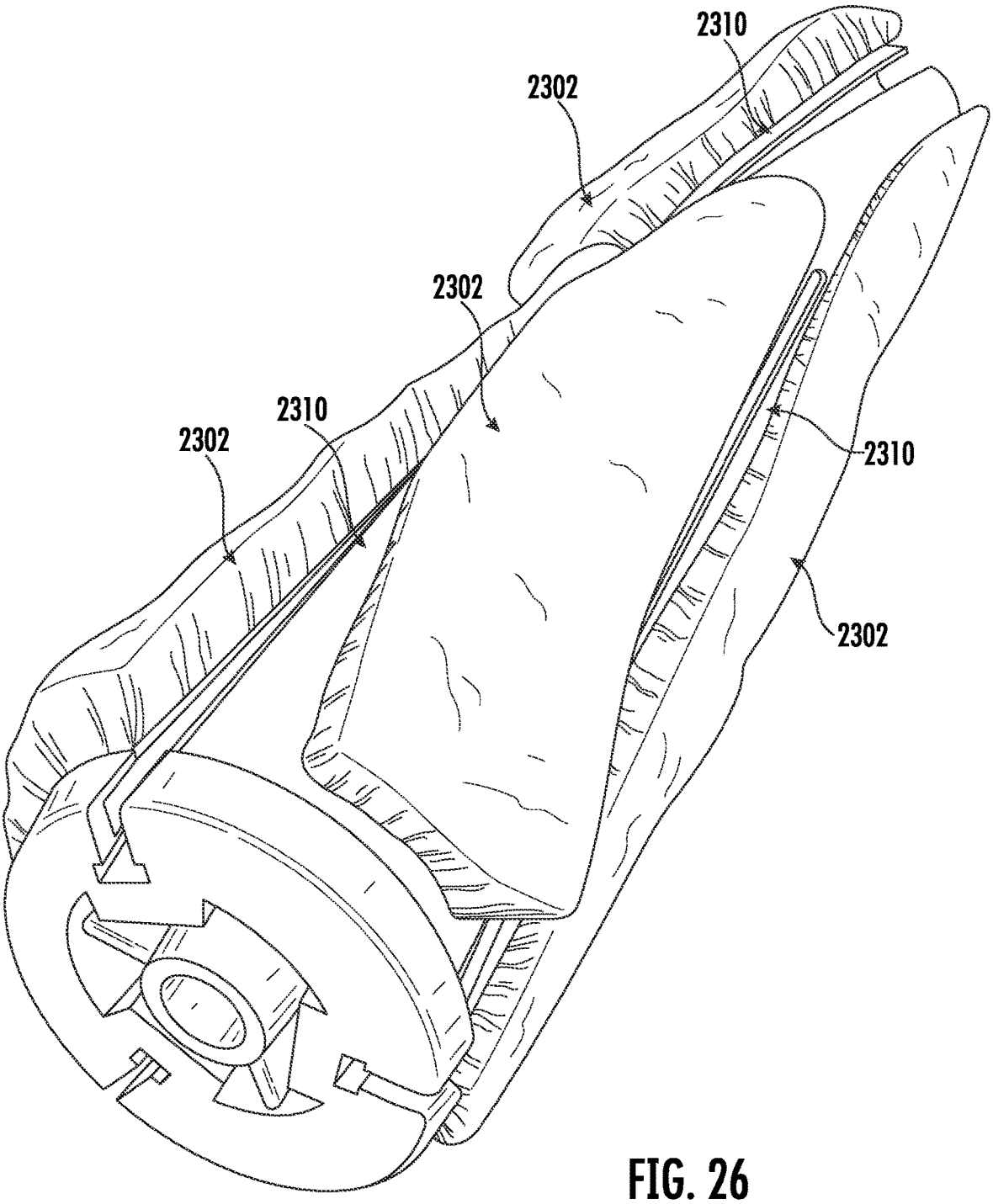
FIG. 26 is another partially assembled view of the agitator of FIG. 23, consistent with embodiments of the present disclosure.
Figure 27:
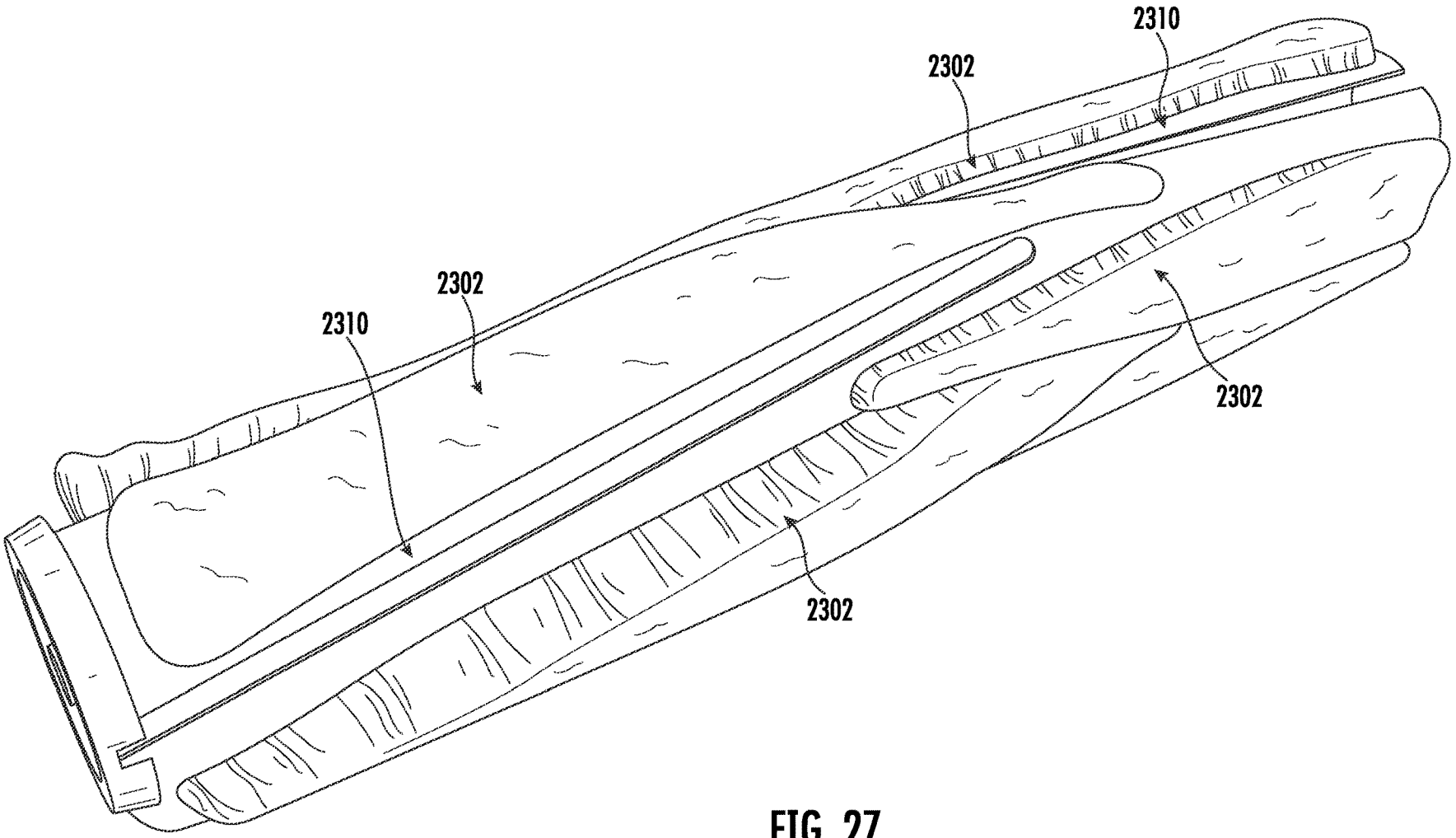
FIG. 27 is a further partially assembled view of the agitator of FIG. 23, consistent with embodiments of the present disclosure.

The channels 2310 may be at least partially formed and/or defined by the soft cleaning feature 2302. In at least one example (see, e.g., FIGS. 25-27), the channel 2310 may have a "U" cross-sectional shape including a base 2312 (which may be formed by the elongated main body 2300) and two sidewalls 2314, 2316 (which may be formed by the soft cleaning feature 2302). The sidewalls 2314, 2316 may be substantially normal to the surface of the elongated main body 2300 and/or may extend at an obtuse and/or acute angle relative to the surface of the elongated main body 2300. Alternatively (or in addition), the channel 2310 may have a "V" cross-sectional shape in which the two sidewalls 2314, 2316 extend from the base region of the resiliently deformable flap 2304.

One or more channels 2310 may extend from one of the ends or end regions 2320, 2322 of the agitator 2210 generally towards a central region 2324 of the agitator 2210. In at least one example, the channels 2310 extends from the ends or end regions 2320, 2322 and terminate in the central region 2324. As such, a length of each of the channels 2310 measures less than a length of the main body 2300. Portion 2326 of the channels 2310 from each end 2320, 2322 may longitudinally overlap with each other in the central region 2324 as the agitator rotates about the pivot axis (i.e., the portions 2326 of the channels 2310 may contact the same area of the floor as the agitator 2310 rotates). The channels 2310 may extend linearly and/or non-linearly across the agitator 2310.

In at least one example, the soft cleaning feature 2302 (e.g., the nap) may extend over a substantial portion of the surface of the cylindrical portion of the elongated main body 2300 (i.e., the portion of the elongated main body 2300 other than the circular ends). As used herein, a substantial portion of the surface of the cylindrical portion of the elongated main body 2300 is intended to mean at least 75% of the surface of the cylindrical portion of the elongated main body 2300, for example, at least 80% of the surface of the cylindrical portion of the elongated main body 2300, at least 85% of the surface of the cylindrical portion of the elongated main body 2300, and/or at least 90% of the surface of the cylindrical portion of the elongated main body 2300, including all values and ranges therein. The soft cleaning feature 2302 may extend over the entire surface of the cylindrical portion of the elongated main body 2300 except where the channels 2310 are located.

The soft cleaning feature 2302 may be formed from a single, unitary piece of material. Alternatively, the soft cleaning feature 2302 may be formed from a plurality of discrete pieces that are coupled to the elongated main body 2300. Forming the soft cleaning feature 2302 formed from a plurality of discrete pieces may aid in manufacturing of the agitator 2210, particularly the formation of the channels 2310.

Figure 33:
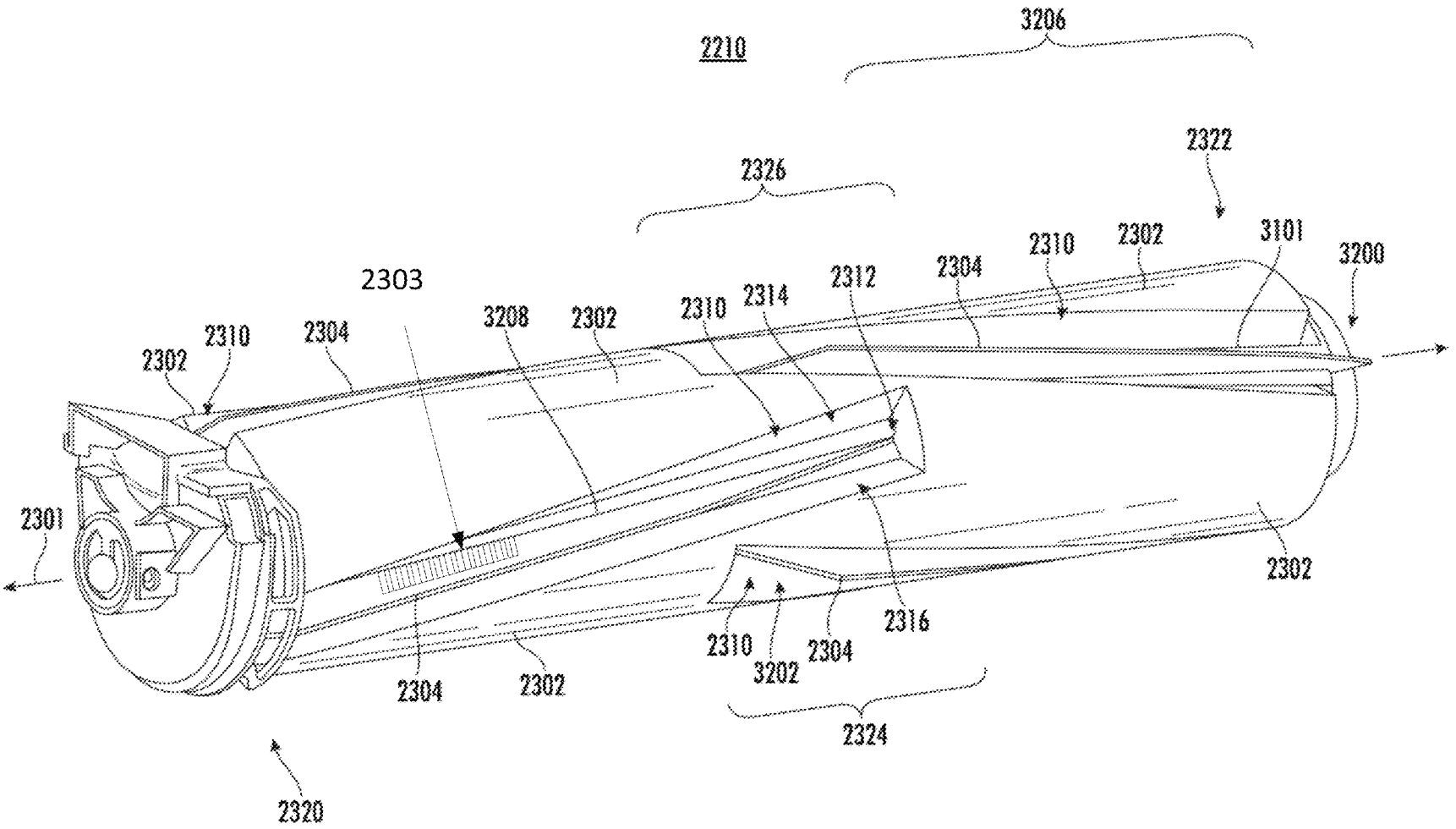
FIG. 33 is another perspective view of the agitator of FIG. 22, consistent with embodiments of the present disclosure.

As noted herein, the agitator 2210 may include a plurality of deformable flaps 2304, wherein a length of each of the deformable flaps 2304 measures less than a length of the main body 2300. As shown, the agitator 2210 includes a plurality of deformable flaps 2304 that extend from end regions 2320, 2322 of the agitator 2210 and/or main body 2300 to a central region 2324 of the agitator 2210 and/or main body 2300, As discussed herein, the agitator 2210 may not include any bristles 2303. FIG. 33; however, it should be appreciated that the agitator 2210 may optionally include bristles in addition to (or without) the flaps 2304 (e.g., bristles substantially adjacent to the flaps 2304).

Turning back to FIG. 23, the flap 2304 may extend generally helically around at least a portion of the elongated main body 2300 and may be formed of a resiliently deformable material. One or more of the end regions 3200, 3202 of the flap 2304 may include a chamfer or taper (e.g., the flap 2304 may include a taper in only one or each end region 3200, 3202). As such, the height of the flap 2304 in at least a portion of the end regions 3200, 3202 may be less than the height 3204 of the flap 2304 in a central region 3206. In other words, the taper may cause a cleaning edge 3201 of the flap 2304 to approach the elongated main body 2300. According to one example, the height of the flap 2304 may be measured from a base 3208 of the flap 2304 to the cleaning edge 3201 of the flap 2304, where the base 3208 is configured to be secured to the agitator 2210 (e.g., the elongated main body 2300). Alternatively, the height of the flap 2304 may be measured from the axis of rotation of the agitator 2210 to the cleaning edge 3201 of the flap 2304. The taper of the end regions 3200, 3202 may be constant (e.g., linear) and/or nonlinear. In at least one example, the middle of the flap 2304 may have the largest height. The taper of a first end region 3200 may be the same as or different than the taper of the second end region 3202.

The first end region 3200 may be arranged within one of the end regions of the elongated main body 2300 and the second end region 3202 may be arranged within the central region 2324 of the elongated main body 2300. The taper of the first end region 3200 may be configured to be at least partially received in an end cap, for example, a migrating hair end cap such as the end caps described in U.S. Ser. No. 16/656,930, filed Oct. 18, 2019, which is fully incorporated herein by reference. The taper of the first end region 3200 may reduce wear and/or friction between the flap 2304 and the end caps, thereby enhancing the lifespan of the flap 2304 and the end caps. In at least some examples, the taper of the first end region 3200 may reduce fold-over of flap 2304 (both within the end cap and the portion of the flap 2304 disposed proximate to and outside of the end cap) as the flap 2304 rotates within the end cap. Reducing fold-over of the flap 2304 may increase contact between the flap 2304 and the surface to be cleaned, thereby enhancing the cleaning performance.

The taper of the first end region 3200 may have a length and a height. The length may be selected based on the dimensions of the end cap to which it is received. For example, the length may be same as the insertion distance of the flap 2304 in the end cap, shorter than the insertion distance of the flap 2304 in the end cap, or longer than the insertion distance of the flap 2304 in the end cap. The taper of the first end region 3200 helps relieve the bend of the flap 2304 as it is tucked into the end cap. By way of example, the taper of the first end region 3200 may have a length of between 5-9 mm, and a height of between 1-3 mm and/or a length of 7 mm and a height of 2 mm.

The taper of the second end region 3202 may be configured to enhance hair migration along the agitator 2210. In particular, the taper may enhance hair migration since hair will tend to migrate to smallest diameter. Thus, the taper of the second end region 3202 may allow hair to be more effectively migrated towards a specific location. In addition, the taper of the second end region 3202 may function as a hair storage area. To this end, the central region 2324 of the agitator 2210 may have a smaller overall diameter compared to the overall diameter of the proximate end regions 3000, 3002. As such, hair may build up and wrap around the central region 2324 of the agitator 2310. The taper of the second end region 3202 of a first flap 2304 may partially overlap with the taper of the second end region 3202 of an adjacent flap 2304 within the central region 2324. When the flap 2304 is optionally used in combination with a debrider unit and/or ribs as described in U.S. Ser. No. 16/656,930, filed Oct. 18, 2019 (which is fully incorporated herein by reference), the teeth of the debrider unit and/or ribs may optionally be longer in a region proximate the second end region 3202 of the flap 2304.

The dimensions of the taper of the flap 2304 can impact the performance and/or lifespan of the flaps 2304. Increasing the taper (e.g., length and/or height) can improve hair migration; however, too large of a taper can negatively impact cleaning performance. For example, a taper of the second end region 3202 that is too large can result in a gap wherein the flap 2304 does not sufficiently contact the surface to be cleaned. On the other hand, too small of a taper in the second end region 3202 (e.g., length and/or height) may not result in sufficient hair migration.

Experimentation has shown that eliminating the inside chamfer (e.g., eliminating the taper of the second end region 3202) may eliminate the middle gap, which may result in an improved cleaning performance and aesthetic appearance (no chamfer with a kink); however, elimination of the middle gap, may cause hair build up on the agitator 2310 due to insufficient hair migration. A taper in the second end region 3202 having a length that is too short may mitigate and/or eliminate the detrimental effects caused by the middle gap and may encourage migration of hair; however, such a configuration, may result in too steep of a chamfer and may cause a bad kink. For example, experimentation has shown that a taper in the second end region 3202 having a length of 5 mm and a height of 7 mm results in a taper that causes a kink that has an aesthetically displeasing appearance to users and can cause the flap 2304 to fold backwards, which may hurt cleaning/hair removal.

A taper in the second end region 3202 having a length that is too long may improve migration of hair and may not kink the flap 2304; however, it may result in a large middle gap. For example, experimentation has shown that a taper in the second end region 3202 having a length of 30 mm and a height of 7 mm results in a taper having a large cleaning gap that is potentially detrimental to the overall cleaning performance.

The inventors of the instant application have unexpectedly found that a taper in the second end region 3202 having a length of 15-25 mm and a height of 5-12 mm allows hair to migrate, while minimizing the middle cleaning gap and a size of any resulting a kink (e.g., the resulting kink is generally not visible and does not substantially impact performance). By way of non-limiting examples, the taper in the second end region 3202 may have a length of 17-23 mm and a height of 6-10 mm, for example, a length of 20 mm and a height of 7 mm. Put another way, the taper in the second end region 3202 may have a length and a height having a slope of 1 to 0.3, for example, a slope of 0.28 to 0.42, a slope of 0.315 to 0.0385, and/or a slope of 0.35. In at least one example, the second end region 3202 may have a taper of 25×7 mm. The overlap at the central region 2324 of the channels 2310 and/or flaps 2304 may be 10-20 mm.

One or more of the tapers in the first and/or second end regions 3200, 3202 may be formed by removing a portion of the outer, cleaning edge 3201 of the flap 2304 (e.g., the edge that contacts the surface to be cleaned). This is particularly useful when the flap 2304 is formed from a non-woven material (such as, but not limited to rubber, plastic, silicon, or the like).

In embodiments where the flap 2304 is formed, at least in part, from a woven material, it may be desirable to maintain a selvedge in one or more of the first and/or second end regions 3200, 3202. The selvedge extends along the cleaning edge 3201 of the flap 2304 and the selvedge may improve wear resistance of the flap 2304 when to a portion of the cleaning edge 3201 of the flap 2304 that the does not include a selvedge (e.g., if a portion of the flap 2304 were removed to create the taper). In at least one example, a manufacturer's selvedge is maintained, and one or more of the tapers in the first and/or second end regions 3300, 3202 may be formed modifying the mounting edge of the flap 2304. In particular, the cleaning edge 3201 of the flap 2304 may be substantially linear prior to mounting to the agitator, and the mounting edge (which may also be the base) of the flap 2304, in the regions of the first and/or second end regions 3200, 3202, may have a reduced length compared to the length of the flap

2304 in the central region 2324 (e.g., the middle). In at least one example, the mounting edge may include a plurality of segments (e.g., a plurality of contoured "T" segments produced in a mold) that straighten out when the flap 2304 is installed in the agitator body 2300, thereby resulting in a contoured (e.g., tapered) selvedge in the first and/or second end regions 3200, 3202. In other words, the flap 2304 may generally be described as including the plurality of segment along the mounting edge that, when mounted to the body 2300, cause a taper to be formed within the flap 2304.

Figure 28:
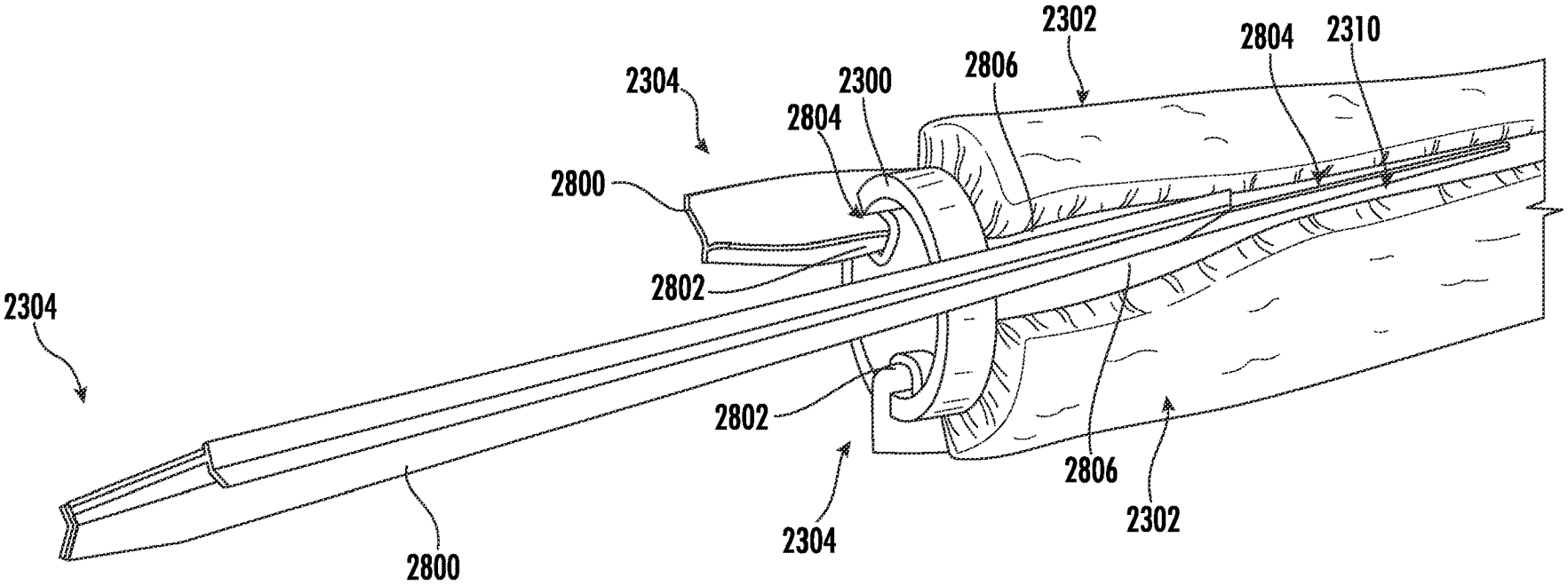
FIG. 28 is a partially assembled view of the agitator of FIG. 23 including the resiliently deformable flaps, consistent with embodiments of the present disclosure.
Figure 29:
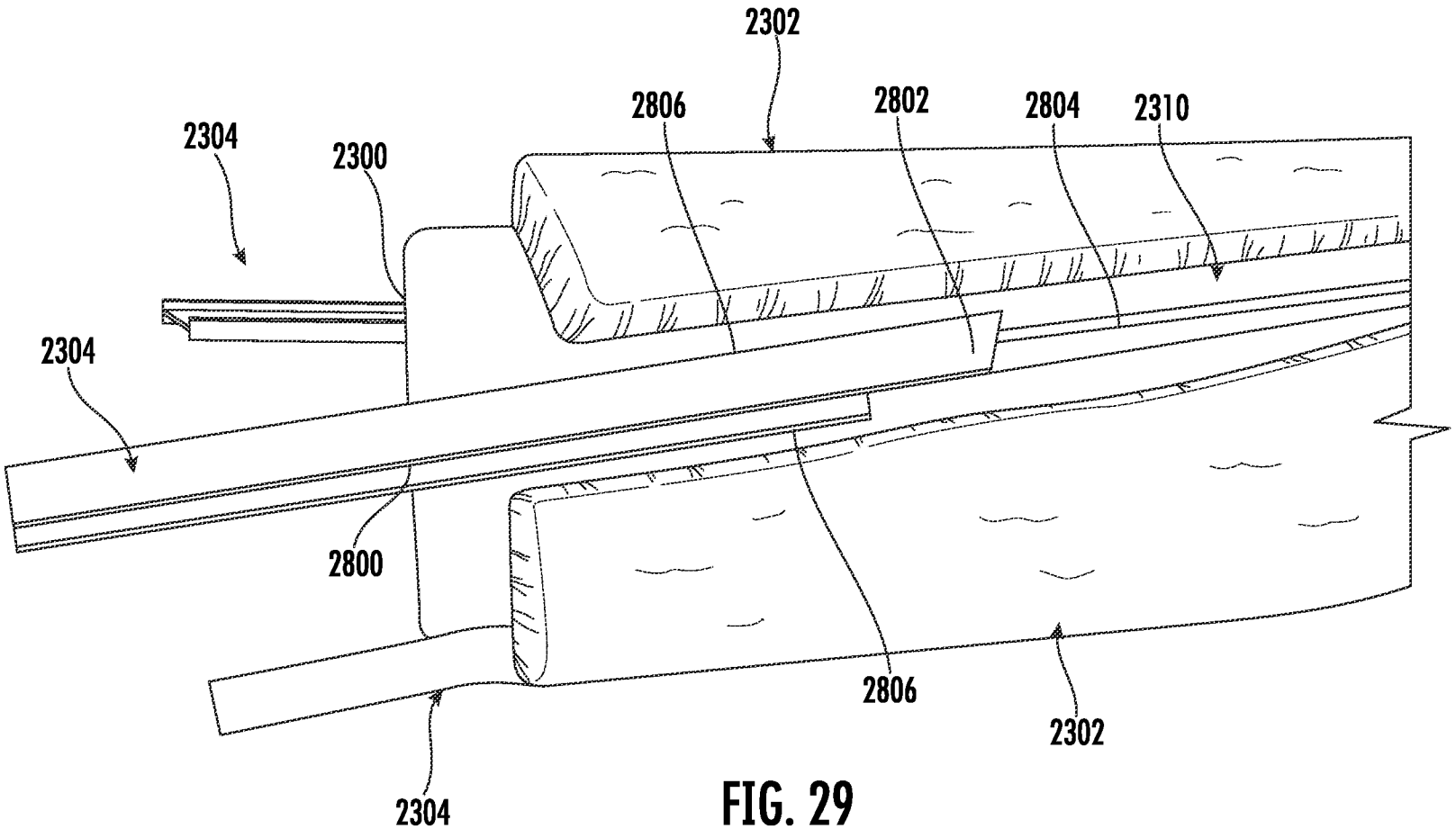
FIG. 29 is another partially assembled view of the agitator of FIG. 23 including the resiliently deformable flaps, consistent with embodiments of the present disclosure.
Figure 30:
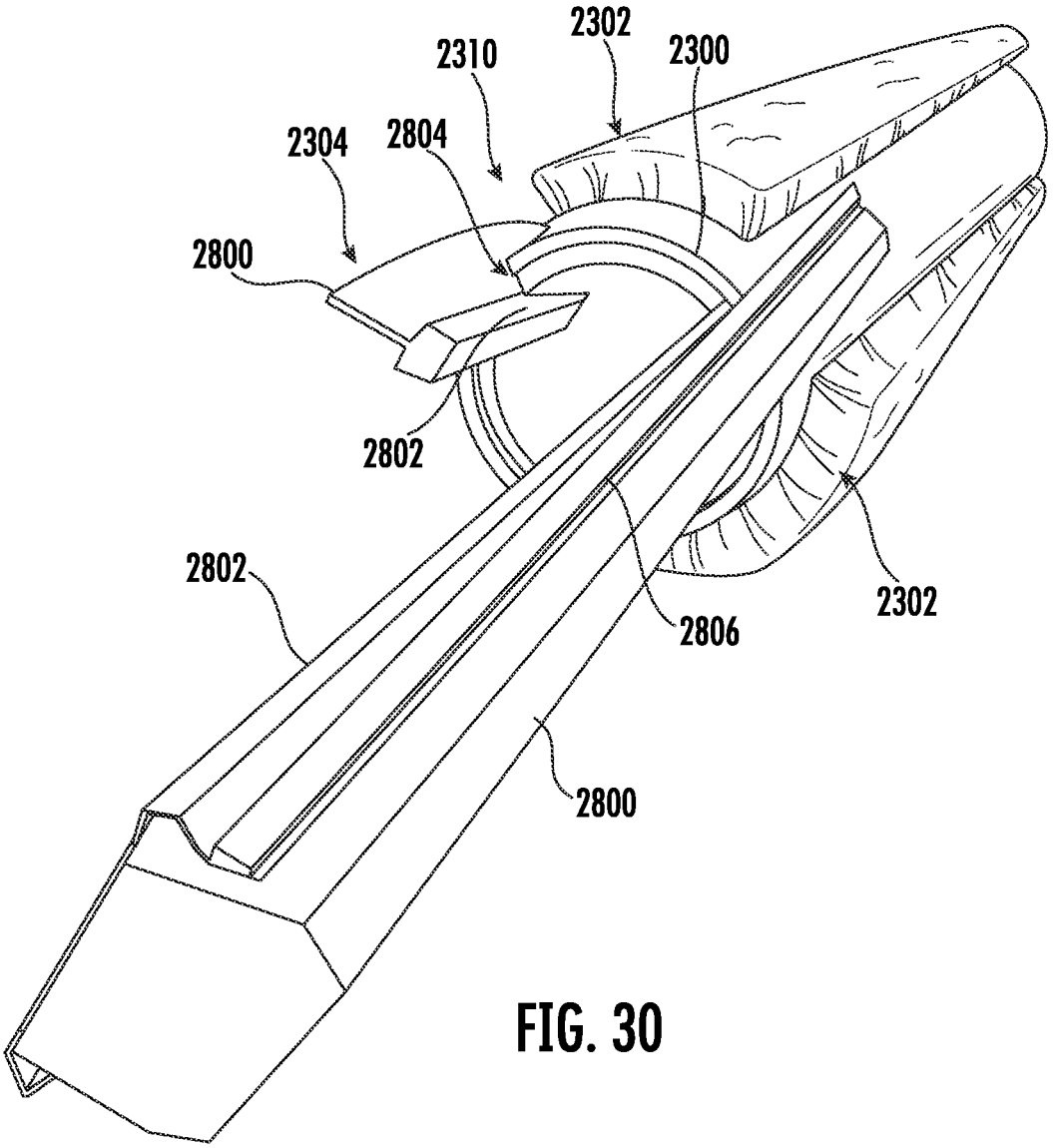
FIG. 30 is a further partially assembled view of the agitator of FIG. 23 including the resiliently deformable flaps, consistent with embodiments of the present disclosure.
Figure 31:
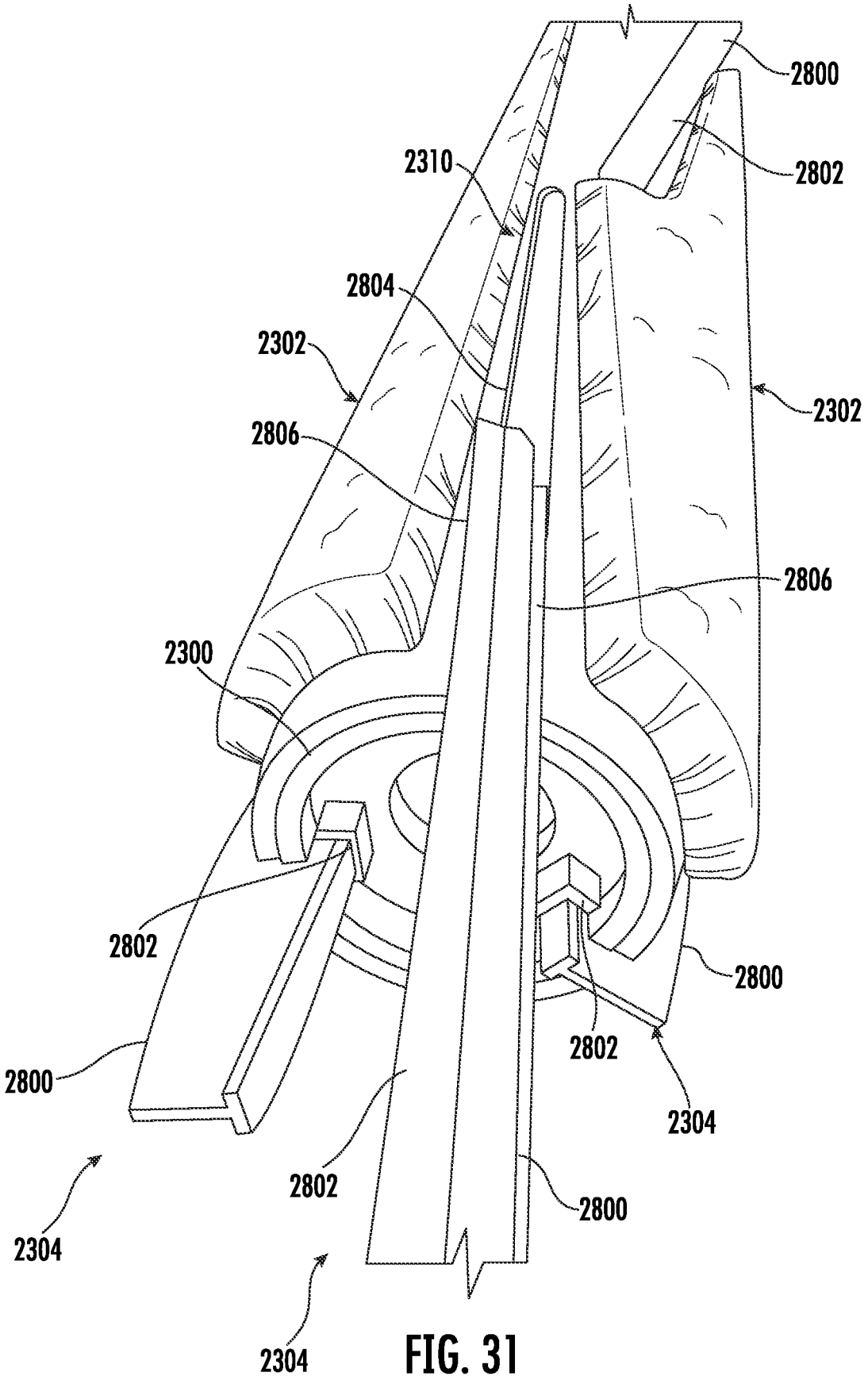
FIG. 31 is a yet another partially assembled view of the agitator of FIG. 23 including the resiliently deformable flaps, consistent with embodiments of the present disclosure.

In at least one example, the flap 2304 (see, e.g., FIGS. 28-30) may include a protrusion 2800 extending generally outward from a base 2802. The protrusion 2800 may be formed, at least in part, from a polyester fabric. Optionally, the back of the protrusion 2800 (viewed based on the rotation of the agitator 2310) may include a silicon layer, and the front of the protrusion 2800 may include the polyester fabric. The protrusion 2800 may have a height of 8-12 mm from the base 2802, for example, 10.1 or 10.6 mm. The protrusion 2800 extend below the outer surface of the soft cleaning feature 2302, substantially even with the soft cleaning feature 2302, or beyond the outer surface of the soft cleaning feature 2302. In at least one example, the protrusion 2800 may extend up to 3 mm beyond the outer surface of the soft cleaning feature 2302, for example, approximately 0.5-2 mm beyond the outer surface of the soft cleaning feature 2302 and/or approximately 1-1.5 mm beyond the outer surface of the soft cleaning feature 2302.

The base 2802 may be configured to secure the flap 2304 to the agitator 2210 (e.g., the elongated main body 2300) such that the protrusion 2800 extends generally radially outward from the agitator 2210. In at least one example, the base 2802 may be configured to be at least partially received within a slot or groove 2804 formed in the agitator 2210 (e.g., the elongated main body 2300) and disposed within channel 2310. The base 2802 and the slot 2804 may form a T-slot type connection; however, it should be appreciated that the base 2802 and the slot 2804 may form any other type of connection. Optionally, the base 2802 may include a retainer 2806 extending outward beyond the main body 2300. The retainer 2806 may be configured to be extend over a portion of the soft cleaning feature 2302, and may be configured to aid in securing the soft cleaning feature 2302 to the agitator and generally prevent the soft cleaning feature 2302 from becoming snagged caught and dislodged as the agitator rotates. For example, the retainer 2806 may include one or more ledges or extensions that press the soft cleaning feature 2302 (e.g., the pile or nap) against the main body 2300) as the flap 2304 is advanced into the slot 2804.

Figure 32:
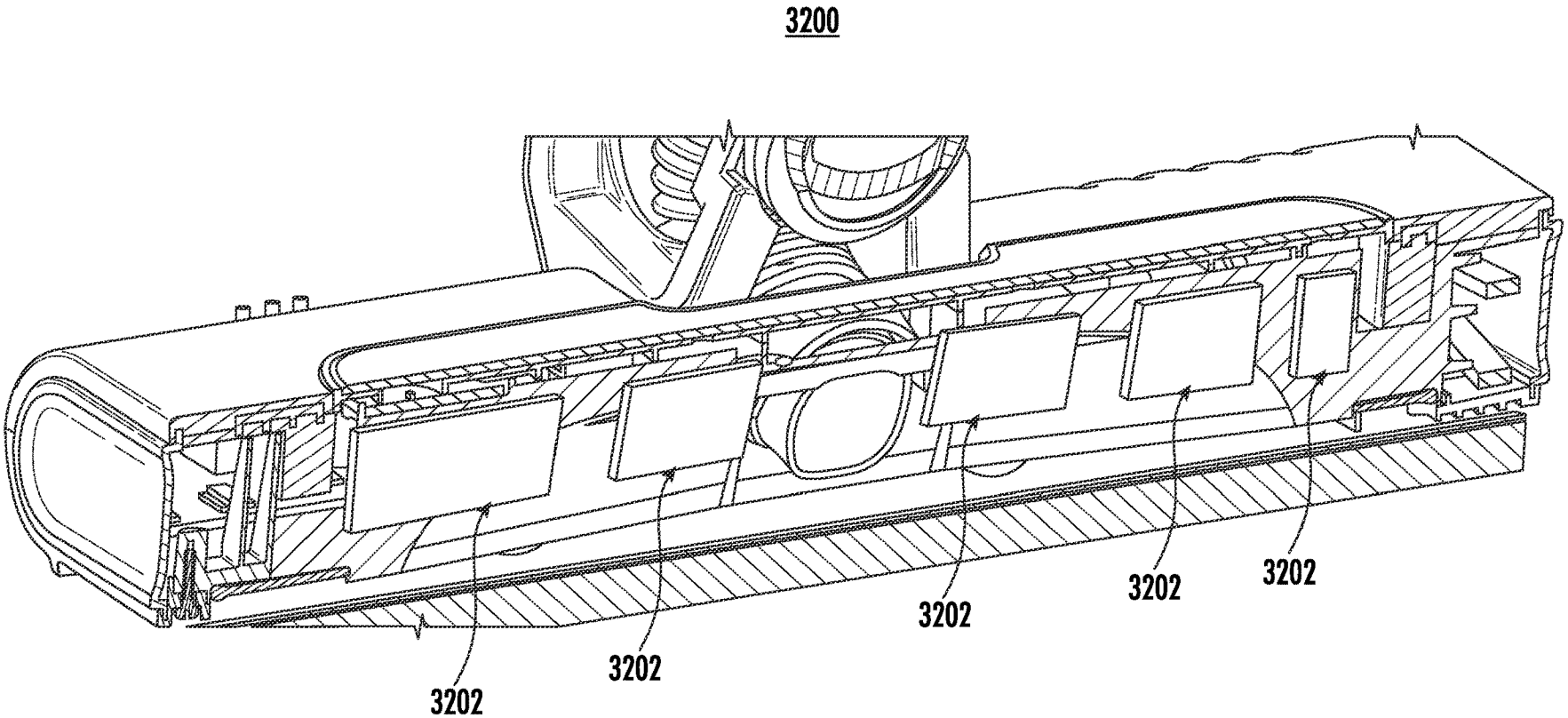
FIG. 32 is a cross-sectional view of another nozzle including a plurality of vibration dampeners, consistent with embodiments of the present disclosure.

Turning now to FIG. 32, another example of a nozzle 3100 consistent with the present disclosure is generally illustrated. The nozzle 3100 may include one or more vibration dampeners 3102 configured to reduce vibration and/or noise generated by the nozzle 3100 as the agitator rotates within the agitation chamber. In one example, the vibration dampeners 3102 may include isobutyl rubber (e.g., Dynamat or an equivalent thereof) adhered to the brushroll window for vibration damping. The vibration dampeners 3102 may also be disposed along one or more portions of the inner or outer surface of the agitation chamber.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. It will be appreciated by a person skilled in the art that a surface cleaning apparatus and/or agitator may embody any one or more of the features contained herein and that the features may be used in any particular combination or sub-combination. Modifications and substitutions by one of ordinary skill in the art are considered to be within the scope of the present invention, which is not to be limited except by the claims.

What is claimed is:

1. An agitator comprising:

an elongated main body configured to rotate about a rotational axis, the elongated main body having a first end region, a second end region disposed opposite the first end region, and a central region disposed between the first and the second end regions;

one or more soft cleaning features coupled to the elongated main body, the one or more soft cleaning features at least partially defining:

a first channel extending between the first end region and the second end region without extending to at least one of the first end region or the second end region; and a second channel extending between the first end region and the second end region without extending to one of the first end region or the second end region, wherein the first and second channels partially longitudinally overlap in the central region as agitator rotates about the rotational axis;

a first deformable flap disposed at least partially within the first channel and having a first fore and a first aft surface extending parallel to each other which terminate along a first cleaning edge, wherein at least a portion of the first fore and the first aft surface face the one or more soft cleaning features; and a second deformable flap disposed at least partially within the second channel and having a second fore and a second aft surface extending parallel to each other which terminate along a second cleaning edge, wherein at least a portion of the second fore and the second aft surface face the one or more soft cleaning features.

2. The agitator of claim 1, wherein the first deformable flap extends radially beyond an outer surface of the one or more soft cleaning features.

3. The agitator of claim 1, wherein the first channel extending from the first end region and ending in the central region; and the second channel extending from the second end region and ending in the central region.

4. The agitator of claim 3, further comprising:

the first channel is disposed within said one or more soft cleaning features; and the second channel is disposed within said one or more soft cleaning features.

5. The agitator of claim 1, wherein the first channel is configured to allow the first deformable flap to move front to back as the agitator rotates about the rotational axis.

6. The agitator of claim 1, wherein the first and the second deformable flaps each extend from the elongated main body.

7. The agitator of claim 1, wherein the first deformable flap has substantially the same length as the first channel and wherein the second deformable flap has substantially the same length as the second channel.

8. The agitator of claim 1, wherein the first and second deformable flaps partially longitudinally overlap in the central region as agitator rotates about the rotational axis.

9. The agitator of claim 1, wherein a height of said first deformable flap in at least a portion of a first end region of said first deformable flap is less than a height of said first deformable flap in a central region of said first deformable flap.

10. The agitator of claim 9, wherein a first end of said first deformable flap is configured to be arranged about said first end region of said main body and a second end of said first deformable flap is configured to be disposed about the central region of the main body.

11. The agitator of claim 1, wherein the first deformable flap extends from the first end region partially towards the second end region, and wherein the second deformable flap extends from the second end region partially towards the first end region.

12. An agitator comprising:

an elongated main body configured to rotate about a rotational axis, the elongated main body having a first end region, a second end region disposed opposite the first end region, and a central region disposed between the first and the second end regions;

one or more soft cleaning features coupled to the elongated main body, the one or more soft cleaning features at least partially defining:

a first channel extending between the first end region and the second end region without extending to at least one of the first end region or the second end region; and a second channel extending between the first end and the second end without extending to one of the first end or the second end;

a first deformable flap disposed at least partially within the first channel and having a first fore and a first aft surface extending parallel to each other which terminate along a first cleaning edge, wherein at least a portion of the first fore and the first aft surface face the one or more soft cleaning features; and a second deformable flap disposed at least partially within the second channel and having a second fore and a second aft surface extending parallel to each other which terminate along a second cleaning edge, wherein at least a portion of the second fore and the second aft surface face the one or more soft cleaning features, wherein the first and second deformable flaps partially longitudinally overlap in the central region as agitator rotates about the rotational axis.

13. An agitator comprising:

an elongated main body configured to rotate about a rotational axis, the elongated main body having a first end region and a second end region disposed opposite the first end region;

one or more soft cleaning features coupled to and extending over a substantial portion of a surface of the elongated main body, the one or more soft cleaning features at least partially defining:

a first channel extending between the first end region and the second end region without extending to at least one of the first end region or the second end region; and a second channel extending between the second end region and the first end region without extending to at least one of the first end region or the second end region, wherein portions of said first and said second channels partially longitudinally overlap with each other as said agitator rotates about said rotational axis; and a first and a second set of bristles disposed within the first and second channels, respectively.

14. The agitator of claim 13, further comprising:

a first deformable flap disposed within the first channel; and a second deformable flap disposed within the second channel.

15. The agitator of claim 14, wherein the first set of bristles are substantially adjacent to the first deformable flap and wherein the second set of bristles are substantially adjacent to the second deformable flap.

16. The agitator of claim 13, wherein the elongated main body includes a central region disposed between the first and the second end regions;

wherein the first set of bristles ends in the central region.

17. The agitator of claim 13 further comprising:

a first deformable flap disposed within the first channel and extending from the first end region partially towards the second end region; and a second deformable flap disposed within the second channel and extending from the second end region partially towards the first end region.

18. The agitator of claim 17, wherein the elongated main body includes a central region disposed between the first and the second end regions and wherein the first deformable flap ends in the central region the second deformable flap ends in the central region.

19. The agitator of claim 13, wherein lengths of said first and said second set of bristles are each less than a length of said elongated main body.

20. An agitator comprising:

an elongated main body configured to rotate about a rotational axis, the elongated main body having a first end region and a second end region disposed opposite the first end region;

one or more soft cleaning features coupled to the elongated main body, the one or more soft cleaning features at least partially defining:

a first channel disposed within said one or more soft cleaning features and extending between the first end and the second end without extending to at least one of the first end region or the second end region; and a second channel disposed within said one or more soft cleaning features and extending between the first end region and the second end region without extending to one of the first end region or the second end region, wherein portions of said first and said second channels partially longitudinally overlap with each other as said agitator rotates about said rotational axis;

a first deformable flap disposed at least partially within the first channel; and a second deformable flap disposed at least partially within the second channel.

21. An agitator comprising:

an elongated main body configured to rotate about a rotational axis, the elongated main body having a first end region and a second end region disposed opposite the first end region;

one or more soft cleaning features coupled to the elongated main body, the one or more soft cleaning features at least partially defining:

a first channel extending between the first end region and the second end region without extending to at least one of the first end region or the second end region; and a second channel extending between the first end and the second end without extending to one of the first end or the second end;

a first deformable flap disposed at least partially within the first channel, wherein the first deformable flap extends radially beyond an outer surface of the one or more soft cleaning features; and a second deformable flap disposed at least partially within the second channel.

22. The agitator of claim 21, wherein portions of said first and said second channels partially longitudinally overlap with each other as said agitator rotates about said rotational axis.

* * * * *